US009107473B2

(12) United States Patent
Heard et al.

(10) Patent No.: US 9,107,473 B2
(45) Date of Patent: Aug. 18, 2015

(54) FOOT SUPPORT STRUCTURE AND ARTICLES INCORPORATING SAME

(71) Applicant: NIKE, Inc., Beaverton, OR (US)

(72) Inventors: Joshua P. Heard, Happy Valley, OR (US); Alexandre Baudouin, Portland, OR (US); Robert M. Bruce, Portland, OR (US); John Hurd, Lake Oswego, OR (US); James Molyneux, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 267 days.

(21) Appl. No.: 13/827,539

(22) Filed: Mar. 14, 2013

(65) Prior Publication Data

US 2014/0259786 A1 Sep. 18, 2014

(51) Int. Cl.

| | |
|---|---|
| ***A43B 13/14*** | (2006.01) |
| ***A43B 7/24*** | (2006.01) |
| ***A43B 13/16*** | (2006.01) |
| ***A43B 13/18*** | (2006.01) |

(52) U.S. Cl.

CPC . *A43B 13/14* (2013.01); *A43B 7/24* (2013.01); *A43B 13/141* (2013.01); *A43B 13/16* (2013.01); *A43B 13/187* (2013.01)

(58) Field of Classification Search

CPC ..... A43B 7/14; A43B 13/00; A43B 13/14; A43B 13/141

See application file for complete search history.

(56) References Cited

U.S. PATENT DOCUMENTS

| | | | | |
|---|---|---|---|---|
| 935,883 | A | 10/1909 | Ball | |
| 1,846,617 | A | 2/1932 | Seremba | |
| 1,928,989 | A | 10/1933 | Zide | |
| 2,897,611 | A | 8/1959 | Schaller | |
| 3,550,597 | A | 12/1970 | Coplans | |
| 4,972,612 | A | 11/1990 | Prukop | |
| 6,145,221 | A | 11/2000 | Hockerson | |
| 6,341,434 | B1 | 1/2002 | Yeh | |
| 6,421,933 | B1 * | 7/2002 | Zamprogno | 36/43 |
| 6,497,058 | B2 | 12/2002 | Dietrich et al. | |
| 7,041,075 | B2 | 5/2006 | Sullivan | |
| 7,082,702 | B2 | 8/2006 | Cretinon | |
| 7,818,897 | B2 | 10/2010 | Geer | |
| 7,850,631 | B2 | 12/2010 | Mitchell | |
| 8,146,269 | B2 * | 4/2012 | Mueller | 36/25 R |
| 2003/0131503 | A1 * | 7/2003 | Erickson et al. | 36/127 |
| 2004/0111920 | A1 * | 6/2004 | Cretinon | 36/30 R |
| 2005/0102859 | A1 | 5/2005 | Yen | |
| 2005/0178024 | A1 * | 8/2005 | Hauglin | 36/25 R |
| 2005/0241187 | A1 * | 11/2005 | Johnson | 36/103 |
| 2006/0130361 | A1 * | 6/2006 | Robinson et al. | 36/25 R |
| 2007/0107264 | A1 * | 5/2007 | Meschter et al. | 36/76 R |
| 2007/0107265 | A1 * | 5/2007 | Mueller et al. | 36/91 |
| 2008/0127523 | A1 * | 6/2008 | Hauglin | 36/117.2 |
| 2008/0229624 | A1 | 9/2008 | Mueller | |
| 2010/0122472 | A1 * | 5/2010 | Wilson et al. | 36/88 |
| 2014/0026441 | A1 * | 1/2014 | Stauffer | 36/103 |
| 2014/0366401 | A1 * | 12/2014 | Cavaliere et al. | 36/103 |

* cited by examiner

*Primary Examiner* — Marie Bays
(74) *Attorney, Agent, or Firm* — Banner & Witcoff, Ltd.

(57) ABSTRACT

A foot support structure for an article of footwear or other foot-receiving device may include a first foot support portion disposed in a first orientation and a second foot support portion disposed in a second orientation different than the first orientation. A twist portion may extend continuously from the first foot support portion to the second foot support portion and twist from the first orientation to the second orientation A common face of the foot support member may extend over at least part of the first foot support portion, at least part of the second foot support portion and the twist portion.

14 Claims, 22 Drawing Sheets

FOOT SUPPORT STRUCTURE AND ARTICLES INCORPORATING SAME

BACKGROUND

Athletic footwear may include uppers and sole structures. An upper may provide a covering for the foot that securely receives and positions the foot with respect to a sole structure. In particular, the upper may form an interior void that has the general shape of the foot. Access to the void may be provided at an ankle opening. The upper may extend over the instep and toe areas of the foot, along the medial and lateral sides of the foot, and around the heel region of the foot. A lacing system or other closure device may be incorporated into the upper and allow selective changes to the size of the ankle opening, thereby permitting a wearer to modify girth and other dimensions of the upper to accommodate feet of varying proportions.

A sole structure may be secured to a lower surface of the upper and generally positioned between a wearer foot and the ground (or other contact surface). The sole structure may incorporate an insole, a midsole, and/or an outsole. The insole (which also may constitute a sock liner) may be a thin member located within the upper and adjacent the plantar (lower) surface of the foot to enhance footwear comfort, e.g., to wick away moisture and provide a soft, comfortable feel. The midsole may be attached to the upper and form a middle layer of the sole structure. The outsole may form the ground-contacting element of footwear and be fashioned from a durable, wear-resistant material that includes texturing and/or other features to improve traction.

In addition to attenuating ground reaction forces, providing traction and protecting a foot from a contact surface or objects thereon, a sole structure may potentially control harmful foot motion. There remains a need for sole structures that include elements able to provide such control.

SUMMARY

This summary is provided to introduce, in a simplified form, concepts that are subsequently described in more detail. This summary is not intended to identify key features or essential features of the invention.

At least some embodiments may include a flexible foot support member. The foot support member may be configured for and/or incorporated into articles of footwear or other foot-receiving devices or structures (e.g., ski or snowboard binders, devices for holding feet during play of video games, etc.). Flexible foot support members of this type, as well as sole structures, articles of footwear, or other foot-receiving devices or structures incorporating such support members, may allow a more natural motion and flexion of a foot during a variety of motions or activities, such as during various phases of a walking or running step cycle, during turn or cutting events, when jumping, etc.

In at least some embodiments, a foot support structure may include at least one foot support member. The foot support member may include a first foot support portion disposed in a first orientation and a second foot support portion disposed in a second orientation different than the first orientation. A twist portion may extend continuously from the first foot support portion to the second foot support portion and twist from the first orientation to the second orientation. A common face of the foot support member may extend over at least part of the first foot support portion, at least part of the second foot support portion and the twist portion.

Additional aspects of this invention relate to footwear sole structures (or other foot-receiving device foot support structures) that include such members, articles of footwear (or other foot-receiving devices) including such members, and methods of making footwear support structures, sole structures, articles of footwear, and/or foot-receiving devices.

DESCRIPTION OF THE FIGURES

The foregoing summary, as well as the following detailed description, will be better understood when considered in conjunction with the accompanying drawings in which like reference numerals refer to the same or similar elements in all of the various views in which that reference number appears. The features in the attached drawings are not necessarily shown to scale.

DETAILED DESCRIPTION

Figure 1:
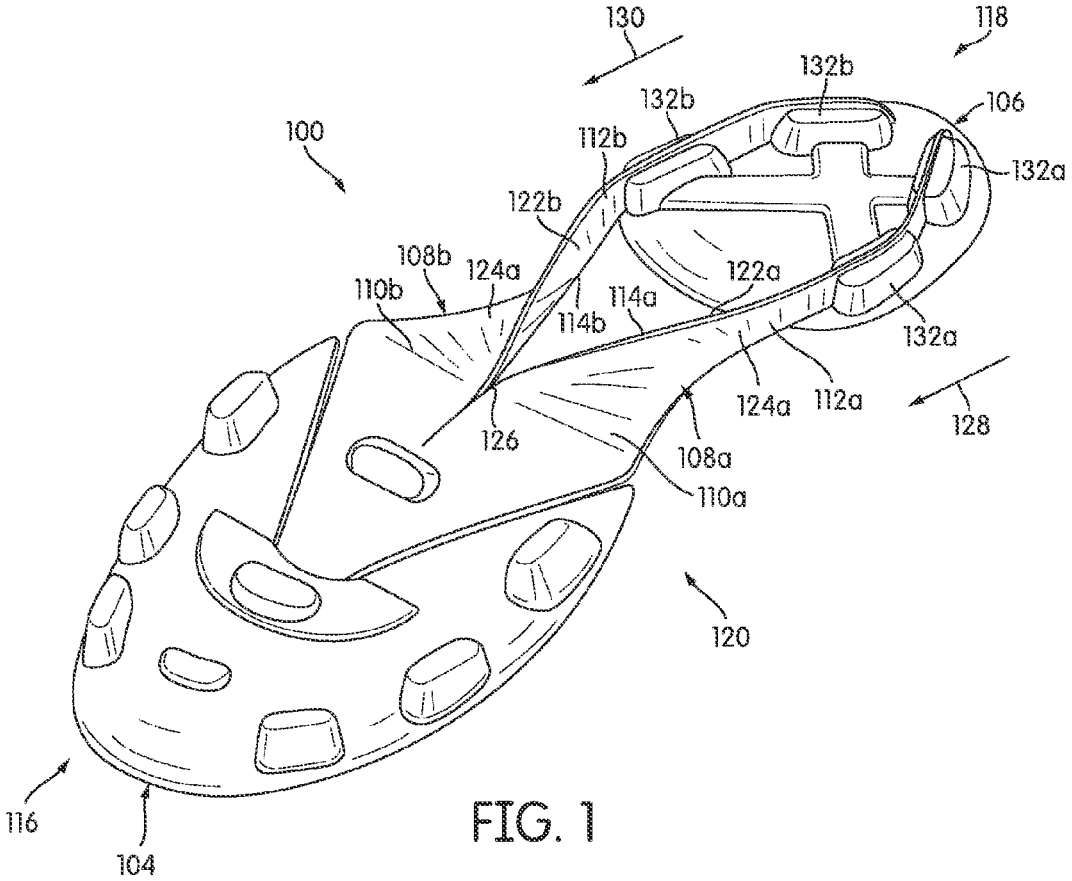
FIGS. 1-4 show a first embodiment of a foot support structure.

In the following description, reference is made to the accompanying drawings, which form a part hereof, and in which several embodiments are shown by way of example. It is to be understood additional embodiments may include structures, environments, and articles other than or in addition to those shown in the drawings or explicitly discussed herein.

Embodiments include, without limitation, foot support structures, sole structures, or other foot support components including such foot support structures, and articles of footwear (e.g., athletic footwear) and other foot-receiving devices that include such foot support structures.

In at least some embodiments, a foot support structure may include a first foot support portion disposed in a first orientation and a second foot support portion disposed in a second orientation different than the first orientation. A twist portion may extend continuously from the first foot support portion to the second foot support portion and twist from the first orientation to the second orientation. A common face of the first foot support portion and the second foot support portion may extend over at least part of the first foot support portion, at least part of the second foot support portion, and the twist portion. That common face may be continuous.

The foot support structure may be embedded in the sole structure of an article of footwear. Although the terms "foot support" and "footbed" are used, the plantar surface of a foot and the footbed of a foot-receiving device need not be in direct contact with the foot support portions or the support plates when the foot-receiving device is in use. Therefore, it will be appreciated that the foot support structure may support a foot with one or more layers of material or other structures separating the plantar surface of the foot and/or the footbed of the foot-receiving device from the foot support structure.

The twisted foot support member may take on a variety of configurations that provide regions of relative flexibility and regions of relative stiffness at the foot support structure. The twisted foot support member of the foot support structure, in accordance with at least some embodiments, may in turn provide regions of relative flexibility at some locations of an article of footwear that incorporates the foot support structure and provide areas of relative stiffness at other locations of the article of footwear. For example, a twisted foot support member may impart flexibility to the foot support structure where a portion of the twisted foot support member is disposed in a generally horizontal orientation relative to a plantar surface of a foot. In this example, the foot support member may also impart stiffness to the foot support structure where a portion of the twisted foot support member is disposed in a generally vertical orientation relative to the plantar surface of the foot. More specifically, during a running or walking step cycle, the rear, lateral side (outside) of the heel typically contacts the ground first, and the foot rolls inward and forward as the step progresses. The flexible regions of the foot support structure thus allow freedom of motion for the foot after initial ground contact and provide flexibility and more natural motion capabilities for the latter parts of a step cycle, e.g., as the force on the foot rolls from back to front, during the rearward push (e.g., off the ball of the foot and/or toes) and toe off phases of a step cycle.

The twist portion of the foot support structure may also provide energy return during a variety of motions or activities, such as during various phases of a walking or running step cycle, during turn or cutting events, when jumping, and the like. In this regard, the twist portion may act like a torsion spring that loads under force (e.g., the weight of the user) and unloads when the force is removed. In other words, the twist portion may load upon initial contact of the foot with the ground and may remain at least partially loaded while the foot remains in contact with the ground. As the foot begins to leave the ground, the twist portion may begin to unload providing energy return to the foot as the twist portion unloads.

If desired, the entire foot support structure may be formed as a unitary, one-piece construction. If desired, the foot support structure may support at least a majority of the plantar surface of a foot. In some more specific examples, the foot support structure may support at least 75%, at least 85%, at least 90%, or even at least 95% of the plantar surface of a foot. At least a portion of the foot support structure may extend continuously from the rearmost heel region of the shoe structure to the forwardmost toe area of the shoe structure and/or may extend continuously from the medial side to the lateral side of the shoe structure (and optionally may underlie or support 100% of a foot).

The foot support structure may be made from a relatively hard but flexible material, such as plastics, fiber or other reinforced polymers (e.g., carbon fiber reinforced plastics, fiberglass, and the like), nylons, and the like. Portions of foot support structure may be a thin, plate-like structure (e.g., less than 3 mm thick, and even less than 2 mm thick) and at least somewhat flexible such that these portions may flex under force (e.g., the weight of the user) and then spring back to their original shape (and thus also potentially provide some return energy to the foot). The foot support structure may be made in any desired manner. For example, the foot support structure may be made using molding techniques, such as by molding polymeric materials, e.g., by compression molding or injection molding. As another example, the foot support structure may be made from fiber-reinforced, polymeric, "pre-preg" materials that are shaped using molds and/or in other manners as are known and used in that art. As a further example, if desired, the foot support structure may be made using rapid manufacturing additive fabrication techniques, such as selective laser sintering, stereolithography, 3D printing, and the like.

A variety of orientations may be selectively employed for the first and second orientations. In one example, the first foot support portion may be oriented such that, edge to edge, it is generally horizontal relative to a plantar surface of a foot such that the first foot support portion faces the plantar surface of the foot, i.e., faces a footbed portion of the sole structure, shoe, or other foot-receiving device. The footbed portion refers to the part of the shoe or other foot-receiving device that is configured to rest under, directly or indirectly, the plantar surface of a foot when the shoe is worn. The second foot support portion, in this example, may be oriented such that, edge to edge, it is generally vertical relative to the plantar surface of a foot such that the second foot support portion faces a side of the foot. In another example, the first foot support portion may be oriented such that, edge to edge, it is generally vertical relative to the plantar surface of a foot such that the first foot support portion faces a side of the foot. The second foot support portion, in this example, may be oriented such that, edge to edge, it is generally horizontal relative to the plantar surface of a foot such that the second foot support portion faces the plantar surface of the foot. In a further example, the first foot support portion may be oriented such that, edge to edge, it is either generally horizontal or generally vertical relative to the plantar surface of the foot, and the second foot support portion may be oriented such that, edge to edge, it is oriented at an oblique angle relative to the first foot support portion. Accordingly, it will be appreciated that various orientations for the foot support portions may be selectively employed.

In the generally horizontal orientation, a foot support portion may also be described as generally parallel relative to the plantar surface of a foot or footbed portion as described above. Similarly, in the generally vertical orientation, a foot support portion may be described as generally perpendicular relative to the plantar surface of a foot or footbed portion as described above. It will be appreciated that because the foot support structure includes a twist portion, the foot support portions may exhibit an uneven contour and therefore may not be exactly flat or planar. As a result, a generally horizontal/parallel or generally vertical/perpendicular orientation may include at least some deviation from a precisely horizontal/parallel or a precisely vertical/perpendicular orientation respectively.

In some example embodiments, the foot support structure may additionally include a third foot support portion disposed in the first orientation similar to the first foot support portion. In these example embodiments, the second foot support portion may be positioned between the first foot support portion and the third foot support portion. The twist portion may thus extend continuously from the second foot support portion to the third foot support portion, and the common face that extends through the twist portion may be a common face of the first foot support portion, the second foot support portion, and the third foot support portion. The third foot support portion may, in some example embodiments, be disposed in a third orientation that is different from the first orientation and the second orientation such that the twist portion twists from the second orientation to the third orientation.

The foot support structure may also include support plates that engage the foot support portions. Support plates may include, for example, a forefoot support plate and a heel support plate. The forefoot support plate may be located at a forefoot region of the foot support structure, and the heel support plate may be located in a heel region of the foot support structure. One of the foot support portions may engage the forefoot support plate, and another one of the foot support portions may engage the heel support plate. The foot support portions may engage the support plates by connecting, mounting, attaching, fastening, and the like to, with, in, on, or at the support plates. A foot support portion may also engage one of the support plates by forming a unitary, one-piece construction with the support plate. The foot support structure may include one or more cleats mounted to the forefoot support plate, to the heel support plate, or to both the forefoot support plate and the heel support plate. The foot support portions may thus engage the support plates by engaging the cleats mounted to the support plates.

In some example embodiments, the first foot support portion may be located in a forefoot region of the foot support structure and engage the forefoot support plate, and the second foot support portion may be located in a heel region of the foot support structure and engage the heel support plate. In other example embodiments, the first foot support portion may be located in the forefoot region and engage the forefoot support plate, the second foot support portion may be located in a midfoot region of the foot support structure, and the third foot support portion may be located in the heel region and engage the heel support plate.

The first foot support portion, the second foot support portion, and the twist portion may comprise a twisted foot support member that extends between the forefoot support plate and the heel support plate. In some example embodiments, the twisted foot support member may extend along a midline of the foot support structure. In other example embodiments, the foot support structure may include a pair of twisted foot support members. In these example embodiments, one of the twisted foot support members may extend along a lateral edge of the foot support structure, and one of the twisted foot support members may extend along a medial edge of the foot support structure. The pair of twisted foot support members may also be joined in some example embodiments at the forefoot support plate or at the heel support plate. By including a pair of twisted foot support members extending respectively along the lateral edge and medial edge of the foot support structure, the lateral side and medial side of the foot are effectively decoupled allowing for a more natural pronation of the foot during a step cycle. More specifically, during a running or walking step cycle, the rear, lateral side (outside) of the heel typically contacts the ground first, and the foot rolls inward and forward as the step progresses. The individual twisted foot support members along the lateral and medial edges of the foot support structure may thus allow freedom of motion for the foot and may allow the medial side of the foot to contact the ground more quickly and easily.

The twist portion may be described as twisting or rotating in a clockwise or counterclockwise direction. For convenience, the following convention is observed herein. A clockwise twist refers to a rotation of a cross section viewed from the front looking toward the rear in a clockwise direction. A counterclockwise twist refers to a rotation of a cross section viewed from the front looking toward the rear in a counterclockwise direction. In some example embodiments, the foot support structure may include two twist portions. As an example, a single twisted foot support member may include two twist portions. As another example each twisted foot support member in a pair of twisted foot support members may each include a twist portion. The two twist portions may twist in the same direction (e.g., both clockwise or both counterclockwise) or in different directions (e.g., one twist portion may twist clockwise and one twist portion may twist counterclockwise). The twist portion may, for example, twist approximately 90° in some example embodiments and approximately 180° in other example embodiments. The degree of twist may be measured, for example, between a substantially flat area of the first foot support portion and a substantially flat area of the second foot support portion. It will be appreciated that additional or alternative degrees of twist may be selectively employed.

Still additional aspects of this disclosure relate to sole structures for articles of footwear (e.g., including midsole and/or outsole components) that have foot support structures of the types described above, as well as to articles of footwear or foot-receiving devices incorporating foot support structures of the types described above.

With regard to embodiments in which a foot support structure is incorporated into an article of footwear, such footwear may include footwear configured for various activities, including, but not limited to: running shoes, walking shoes, cross training shoes, football shoes, hiking shoes, soccer shoes, baseball shoes, track shoes, basketball shoes, skateboard shoes, tennis shoes, and the like. Embodiments also include other types of footwear and foot-receiving devices that include, without limitation, dress shoes, casual shoes, boots, bindings (e.g., for skis or snowboards), devices for holding feet for the play of video games, etc.

Figure 2:
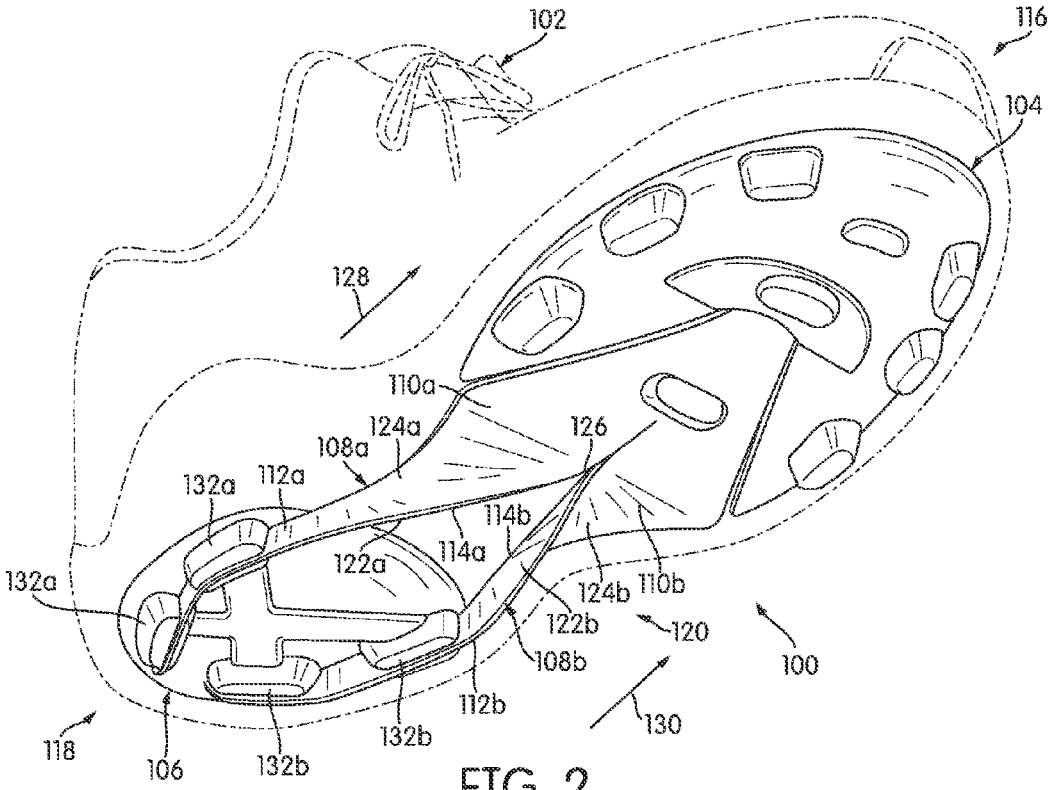
Figure 3:
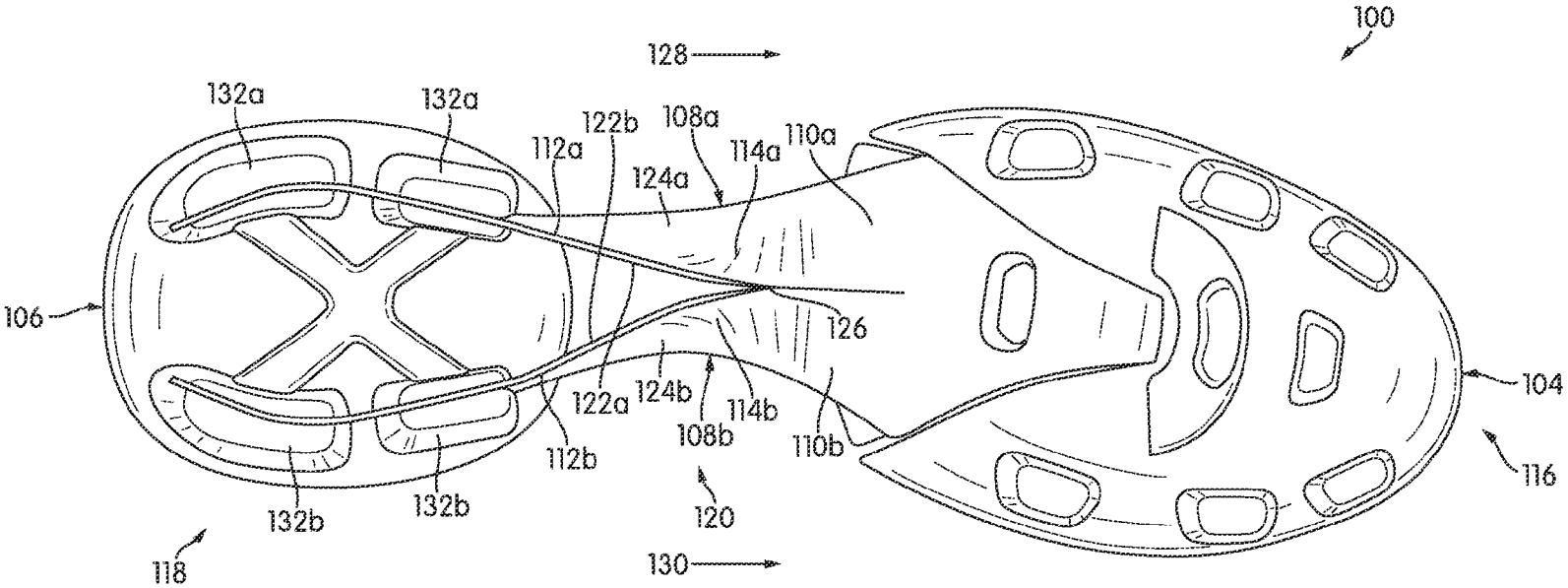
Figure 4:
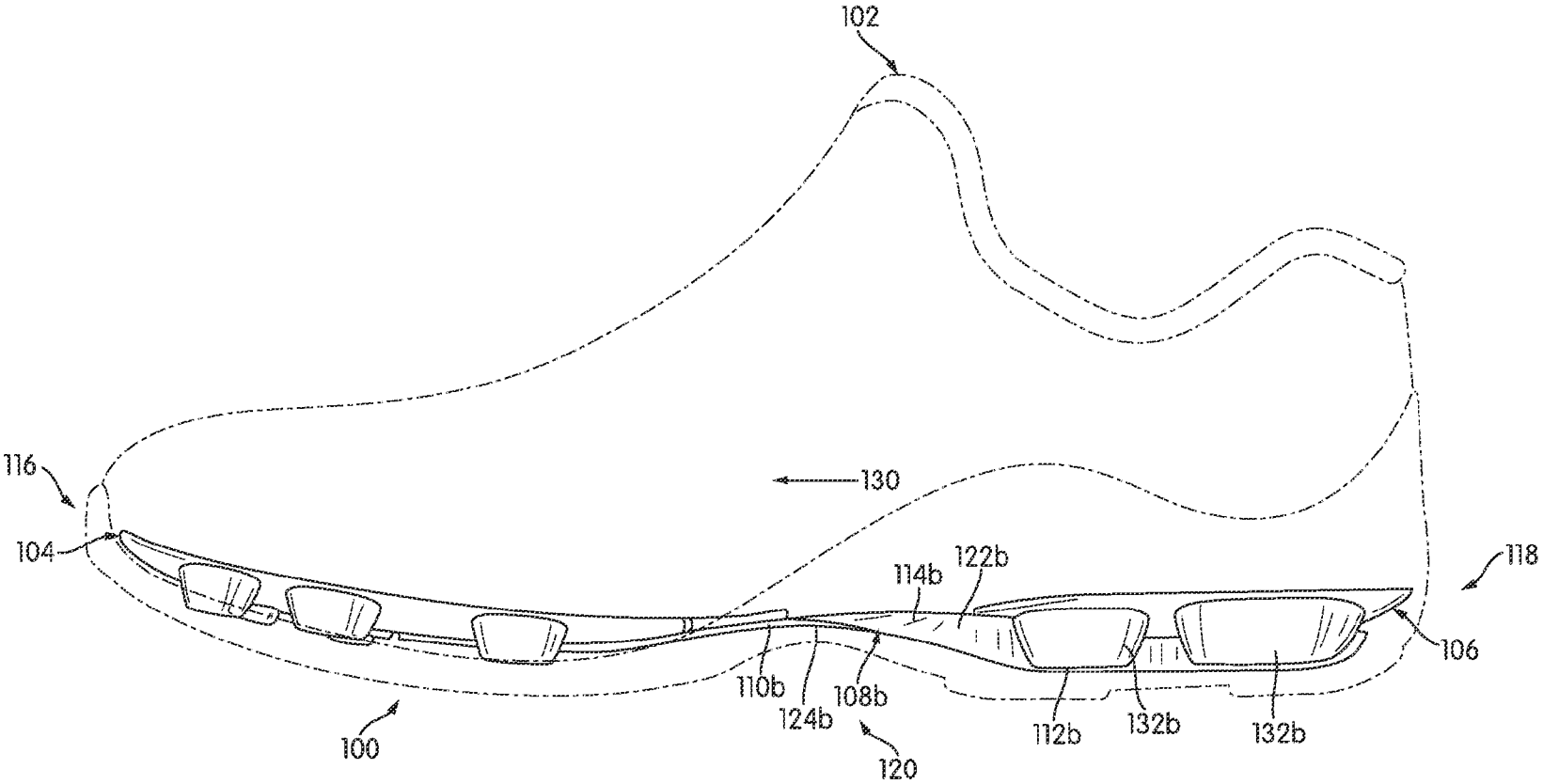

FIGS. 1-4 show a foot support structure 100 according to a first embodiment. FIG. 1 is an inverted perspective view of the foot support structure 100. FIG. 2 is a bottom perspective view of the foot support structure 100 incorporated into an article of footwear 102 (shown in uneven broken lines). FIG. 3 is a bottom view of the foot support structure 100. FIG. 4 is a side view of the foot support structure 100 incorporated into the article of footwear 102. For purposes of convenient reference, the foot support structure 100 may be divided into three general regions: a forefoot region 116, a midfoot region 120, and a heel region 118. These regions 116, 120, and 118 are not intended to demarcate precise areas of 100. Rather the regions 116, 120, and 118 are intended to represent general areas of 100 to provide a frame of reference. Regions of other embodiments of foot support structures may likewise be divided into forefoot, midfoot, and heel regions with such regions likewise not intended to demarcate precise areas, and instead meant to represent general areas.

As seen in FIGS. 1-4, the example foot support structure 100 includes a forefoot support plate 104, a heel support plate 106, and pair of twisted foot support members 108*a* and 108*b*. The twisted foot support member 108*a* includes a first foot support portion 110*a*, a second foot support portion 112*a*, and a twist portion 114*a*. Likewise, the second foot support portion 108*b* includes a first foot support portion 110*b*, a second foot support portion 112*b*, and a twist portion 114*b*. The forefoot support plate 104 is located in a forefoot region 116 of the foot support structure 100. The heel support plate 106 is located in a heel region 118 of the foot support structure 100. The twisted foot support members 108*a* and 108*b* extend through a midfoot region 120 of the foot support structure 100 and engage both the forefoot support plate 104 and the heel support plate 106. More specifically, the first foot support portions 110*a* and 110*b* engage the forefoot support plate 104, and the second foot support portions 112*a* and 112*b* engage the heel support plate 106. Accordingly, the twist portion 114*a* of the twisted foot support member 108*a* is positioned between the first foot support portion 110*a* and the second foot support portion 112*a* and is located in the midfoot region 120 of the foot support structure 100. Similarly, the twist portion 114*b* of the twisted foot support member 108*b* is positioned between the first foot support portion 110*b* and the second foot support portion 112*b* and is located in the midfoot region 120 of the foot support structure 100.

The first foot support portions 110*a* and 110*b* are disposed in a first orientation, which in this example is generally horizontal relative to a plantar surface of a foot. The second foot support portions 112*a* and 112*b* are disposed in a second orientation different than the first orientation, which in this example is generally vertical relative to a plantar surface of a foot. The twist portion 114*a* of the twisted foot support member 108*a* extends continuously from the first foot support portion 110*a* to the second foot support portion 112*a*. Likewise, the twist portion 114*b* of the twisted foot support member 108*b* extends continuously from the first foot support portion 110*b* to the second foot support portion 112*b*. The twist portions 114*a* and 114*b* also twist from the first orientation to the second orientation, which in this example is a twist from a generally horizontal orientation to a generally vertical orientation. Such a twist may be referred to as a "quarter-twist" in that the twist portion twists approximately 90°. In this way, the foot support structure 100 provides an area of relative flexibility where the twisted foot support members 108*a* and 108*b* join the forefoot support plate 104 and an area of relative stiffness where the twisted foot support members join the heel support plate 106. The first foot support portions 110*a* and 110*b*, in this example, are disposed in a generally horizontal orientation. Axes about which each of the first foot support portions 110*a* and 110*b* have less resistance to bending are located in planes that are also disposed in generally horizontal orientations. For example, that axis for the first foot support portion 110*a* lies in a plane that passes through edges of the first foot support portion 110*a*. Axes about which each of the second foot support portions 112*a* and 112*b* have less resistance to bending are located in planes that are disposed in generally vertical orientations. For example, that axis for the second foot support portion 112*a* lies in a plane that passes through edges of the second foot support portion 112*a*. Consequently, axes about which each of the second foot support portions 112*a* and 112*b* have more resistance to bending are located in planes that are disposed in generally horizontal orientations.

The twisted foot support members 108*a* and 108*b* include top faces 122*a* and 122*b*, respectively. Twisted foot support members 108*a* and 108*b* further include bottom faces 124*a* and 124*b*, respectively. Accordingly, the first foot support portion 110*a* and the second foot support portion 112*a* of the twisted foot support member 108*a* may share a common face, e.g., the top face 122*a* and/or the bottom face 124*a*. As seen in FIGS. 1-4, the common top face 122*a* and the common bottom face 124*a* extend continuously across the first foot support portion 110*a*, the second foot support portion 112*a*, and the twist portion 114*a*. Likewise, the first foot support portion 110*b* and the second foot support portion 112*b* of the twisted foot support member 108*b* may also share a common face, e.g., the top face 122*b* and/or the bottom face 124*b*. The common top face 122*b* and the common bottom face 124*b* may similarly extend continuously across the first foot support portion 110*b*, the second foot support portion 114*b*, and the twist portion 114*b*.

At the first foot support portions 110*a* and 110*b* disposed in a generally horizontal orientation, the top faces 122*a* and 122*b* face upward toward a plantar surface of a foot (i.e., toward the footbed portion), and the bottom faces 124*a* and 124*b* face downward away from a plantar surface of a foot (i.e., away from the footbed portion). At the second foot support portions 112*a* and 112*b* disposed in a generally vertical orientation, the top faces 122*a* and 122*b* face inward toward each other, and the bottom faces 124*a* and 124*b* face outward away from each other. Accordingly, it can be seen that the twist portions 114*a* and 114*b* twist in opposite directions. In this example, when observing the shoe 102 from the front, the twist portion 114*a* twists from the first foot support portion 110*a* to the second foot support portion 112*a* in a clockwise direction and the twist portions 114*b* twists from the first foot support portion 110*b* to the second foot support portion 112*b* in a counterclockwise direction. It will be appreciated that, in other example embodiments, alternative configurations for the twist portion may be selectively employed so as to alternatively configure the top and bottom faces of a twisted support member. For example, the twist portion may twist such that the bottom faces 124*a* and 124*b* face inward toward each other and the top faces 122*a* and 122*b* face outward away from each other at the second foot support portions 112*a* and 112*b* disposed in a generally vertical orientation. In other examples, various combinations of the configurations described above may be selectively employed.

The twisted foot support members 108*a* and 108*b* are joined together in a contiguous, unitary construction in this example foot support structure 100. In other words, the first foot support portion 110*a*, the second foot support portion 112*a*, and the twist portion 114*a* of the twisted foot support member 108*a* are one integral piece in this example foot support structure 100. Likewise, the first foot support portion 110*b*, the second foot support portion 112*b*, and the twist portion 114*b* of the twisted foot support member 108*b* are one integral piece in this example foot support structure 100. Moreover, the first foot support portion 110*a* of the twisted foot support member 108*a* is contiguous with the first foot support portion 110*b* of the twisted foot support member 108*b* at the forefoot support plate 104 of the foot support structure 100. The twisted foot support members 108*a* and 108*b* branch off from a bifurcation 126 near the forefoot support plate 104. From the forefoot support plate 104, at least a portion of the twisted foot support member 108*a* extends along a lateral edge 128 of the foot support structure 100, and at least a portion of the twisted foot support member 108*b* extends along a medial edge 130 of the foot support structure. In this way, the twisted foot support members 108*a* and 108*b* decouple the lateral side of a shoe (or other foot-receiving device) from the medial side of the shoe (or other foot-receiving device) to provide for more natural pronation as discussed above.

The foot support structure 100, in this example, also includes one or more cleats 132*a* and 132*b* mounted to the heel support plate 106. The cleats 132*a* may be mounted to the heel support plate 106 near the lateral edge 128 of the foot support structure 100. The cleats 132*b* may be mounted to the heel support plate 106 near the medial edge 130 of the foot support structure 100. The cleats 132*a* and 132*b* may be configured to receive and support the twisted foot support members 108*a* and 108*b* respectively. Accordingly, the twisted foot support member 108*a*, in this example, engages the heel support plate 106 by engaging the cleats 132*a* mounted to the heel support plate. Similarly, the twisted foot support member 108*b*, in this example, engages the heel support plate 106 by engaging the cleats 132*b* mounted to the heel support plate. In this configuration, the twisted foot support members 108*a* and 108*b* may or may not connect directly to the heel support plate 106. For example, the heel support plate 106, the twisted foot support members 108*a* and 108*b*, and the cleats 132*a* and 132*b* may be one integrally molded piece. In another example, the heel support plate 106, the twisted foot support members 108*a* and 108*b*, and the cleats 132*a* and 132*b* may be separate pieces attached together (e.g., glued).

Figure 5:
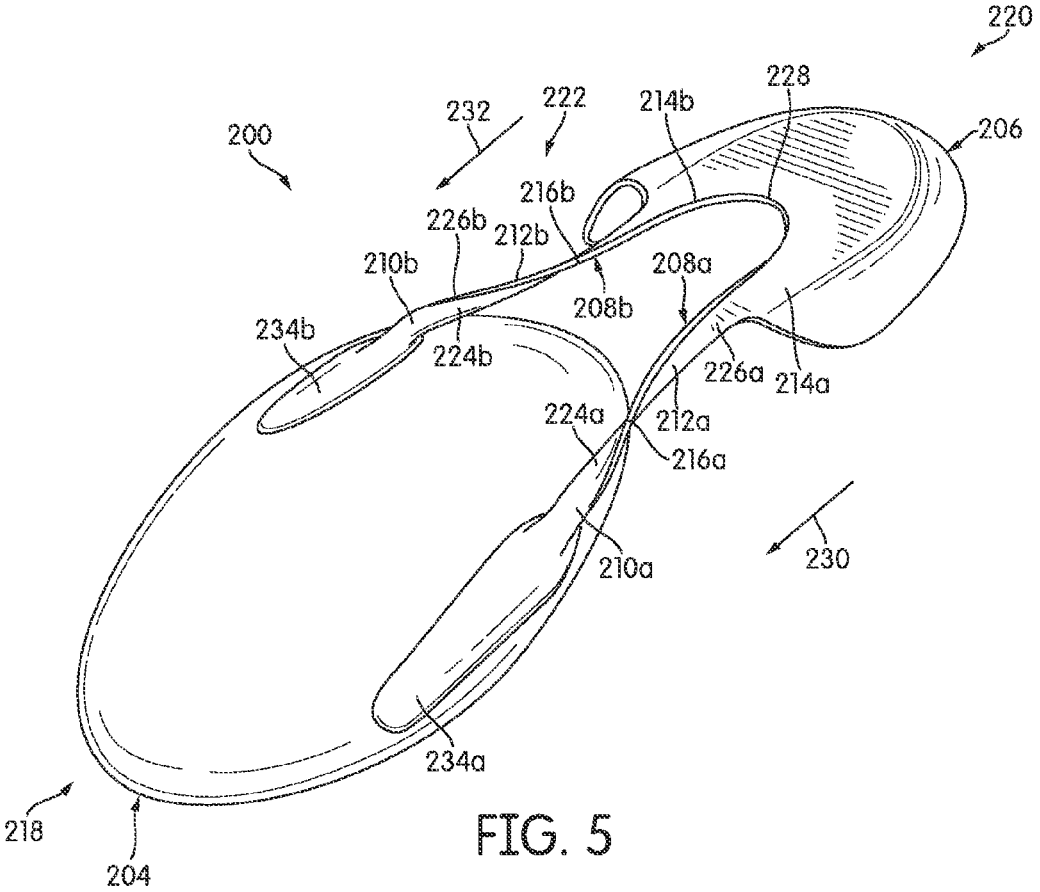
FIGS. 5-8 show a second embodiment of a foot support structure.
Figure 6:
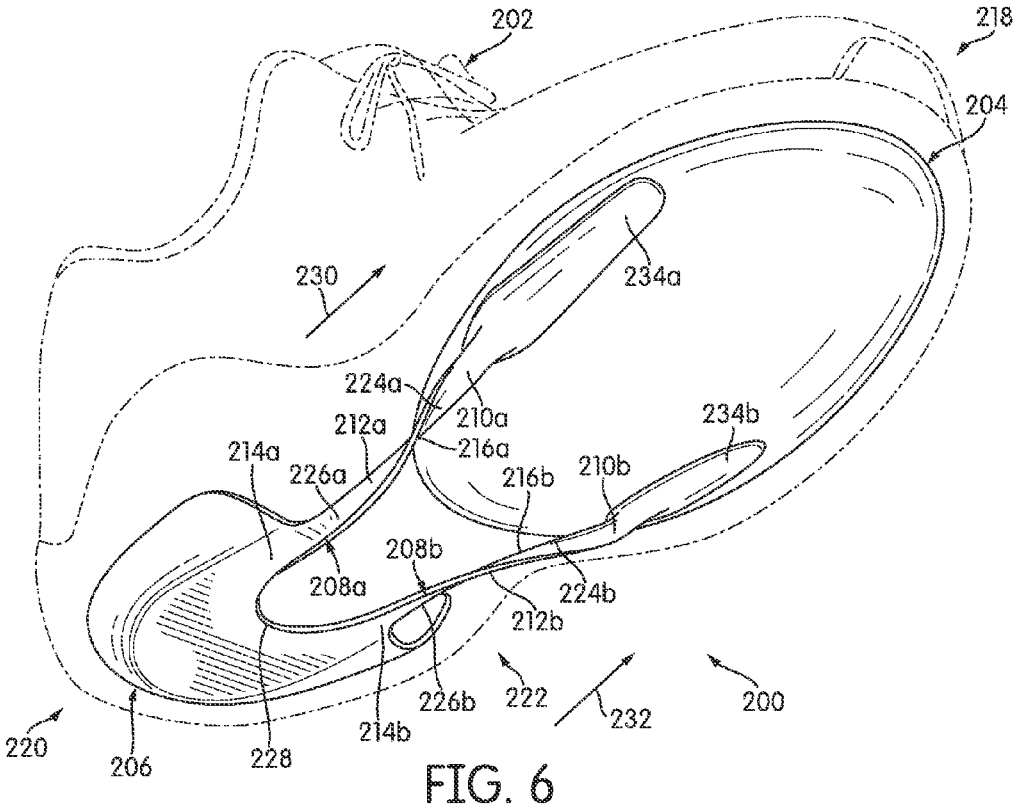
Figure 7:
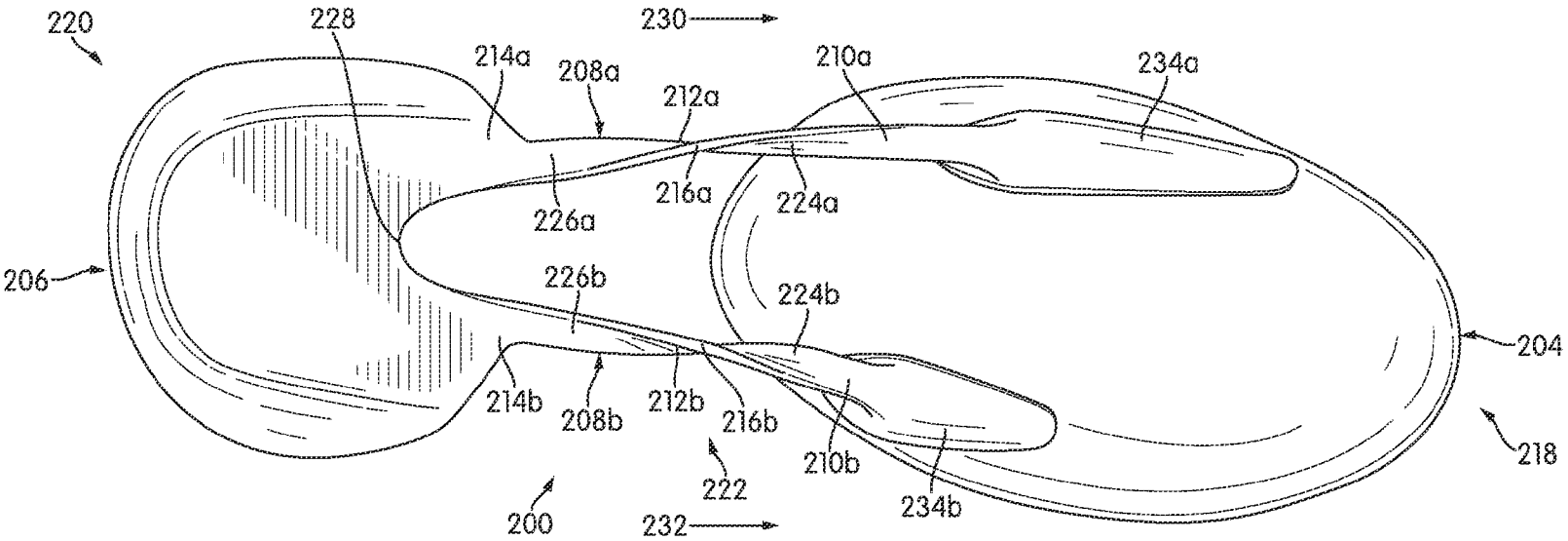
Figure 8:
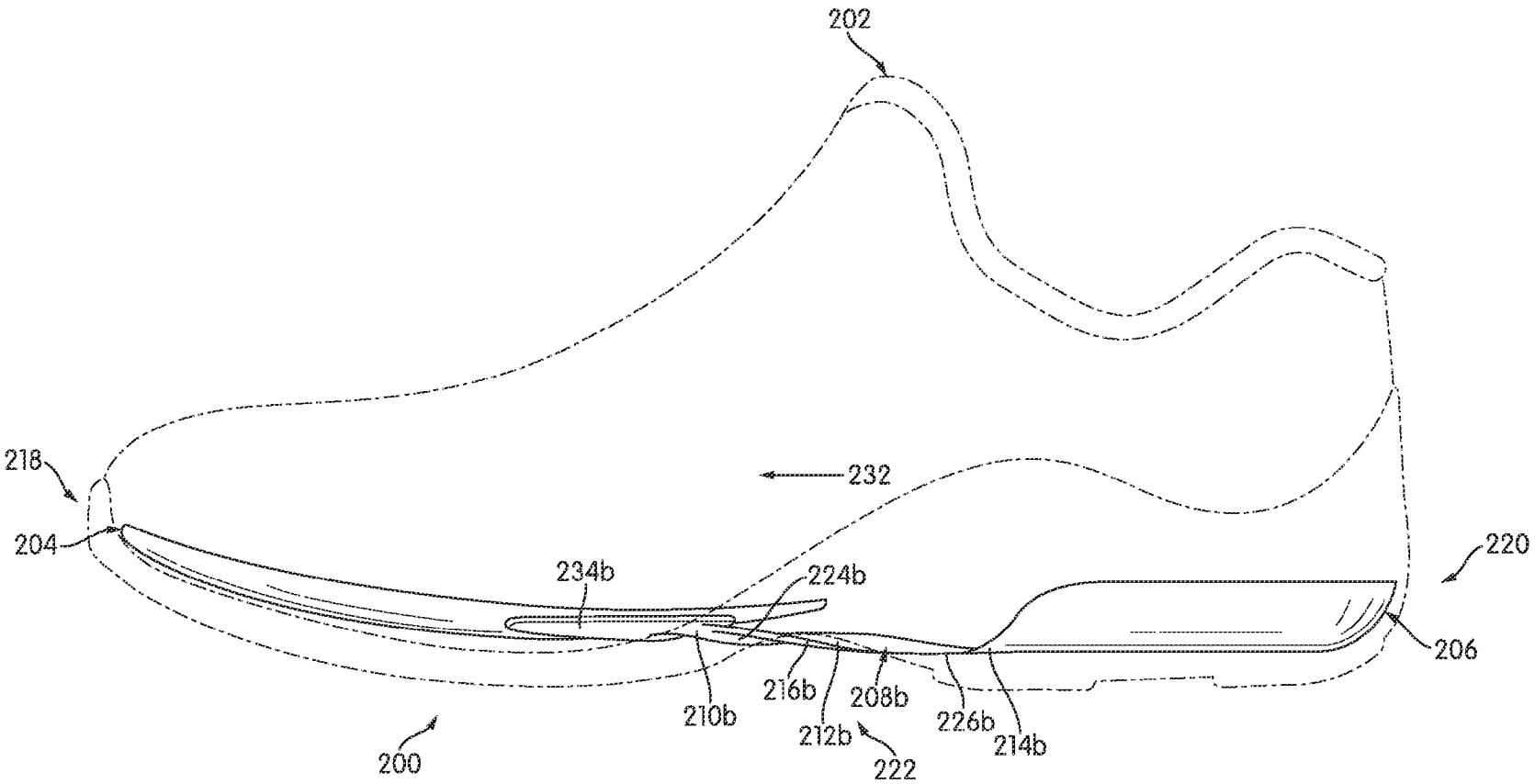

FIGS. 5-8 show a foot support structure 200 according to a second embodiment. FIG. 5 is an inverted perspective view of the foot support structure 200. FIG. 6 is a bottom perspective view of the foot support structure 200 incorporated into an article of footwear 202 (shown in uneven broken lines). FIG. 7, a bottom view of the foot support structure 200. FIG. 8 is a side view of the foot support structure 200 incorporated into the article of footwear 202.

As seen in FIGS. 5-8, the example foot support structure 200 includes a forefoot support plate 204, a heel support plate 206, and pair of twisted foot support members 208*a* and 208*b*. The twisted foot support member 208*a* includes a first foot support portion 210*a*, a second foot support portion 212*a*, third foot support portion 214*a*, and a twist portion 216*a*. Likewise, the second foot support portion 208*b* includes a first foot support portion 210*b*, a second foot support portion 212*b*, a third foot support portion 214*b*, and a twist portion 216*b*. The forefoot support plate 204 is located in a forefoot region 218 of the foot support structure 200. The heel support plate 206 is located in a heel region 220 of the foot support structure 200. The twisted foot support members 208*a* and 208*b* extend through a midfoot region 222 of the foot support structure 200 and engage both the forefoot support plate 204 and the heel support plate 206. More specifically, the first foot support portions 210*a* and 210*b* engage the forefoot support plate 204, and the third foot support portions 214*a* and 214*b* engage the heel support plate 206. Accordingly, the second foot support portion 212*a* and the twist portion 216*a* of the twisted foot support member 208*a* are positioned between the first foot support portion 210*a* and the third foot support portion 214*a* and are located in the midfoot region 222 of the foot support structure 200.

The first foot support portions 210*a* and 210*b* and the third foot support portions 214*a* and 214*b* are disposed in a first orientation, which in this example is generally horizontal relative to a plantar surface of a foot. The second foot support portions 212*a* and 212*b* are disposed in a second orientation different than the first orientation, which in this example is generally vertical relative to a plantar surface of a foot. The twist portion 216*a* of the twisted foot support member 208*a* extends continuously from the first foot support portion 210*a* to the second foot support portion 212*a* as well as from the second foot support portion 212*a* to the third foot support portion 214*a*. Likewise, the twist portion 216*b* of the twisted foot support member 208*b* extends continuously from the first foot support portion 210*b* to the second foot support portion 212*b* as well as from the second foot support portion 212*b* to the third foot support portion 214*b*. Between the first foot support portion 210*a* and the second foot support portion 212*a*, the twist portion 216*a* twists from the first orientation to the second orientation, which in this example is a twist from a generally horizontal orientation to a generally vertical orientation. Between the second foot support portion 212*a* and the third foot support portion 214*a*, the twist portion twists from the second orientation back to the first orientation, which in this example is a twist from a generally vertical orientation to a generally horizontal orientation. The twist portion 216*b* of the foot support member 208*b* may likewise twist from the first orientation to the second orientation between the first foot support portion 210*b* and 212*b* and from the second orientation back to the first orientation between the second foot support portion 212*b* and the third foot support portion 214*b*. The twisting of the twist portions 216*a* and 216*b*, in this example, may be referred to as a "half twist" in that the twist portion twists approximately 180° (i.e., approximately 90° between the first foot support portion and the second foot support portion and again approximately 90° between the second foot support portion and the third foot support portion). In this way, the foot support structure 200 provides areas of relative flexibility in the forefoot region 218 where the first foot support portions 210*a* and 210*b* join the forefoot support plate 204 and in the heel region 220 where the third foot support portions 214*a* and 214*b* join the heel support plate 206. The foot support structure 200 also provides an area of relative stiffness in the midfoot region 222 due to the orientation of the second foot support portions 212*a* and 212*b*. The first foot support portions 210*a* and 210*b* as well as the third foot support portions 214*a* and 214*b*, in this example, are disposed in a generally horizontal orientation. Axes about which each of the first foot support portions 210*a*/210*b* and the third foot support portions 214*a*/214*b* have less resistance to bending are located in planes that are also disposed in generally horizontal orientations. For example, that axis for the first foot support portion 210*a* lies in a plane that passes through edges of the first foot support portion 210*a*. Axes about which each of the second foot support portions 212*a* and 212*b* have less resistance to bending are located in planes that are disposed in generally vertical orientations. For example, that axis for the second foot support portion 212*a* lies in a plane that passes through edges of the second foot support portion 212*a*. Consequently, axes about which each of the second foot support portions 212*a* and 212*b* have more resistance to bending are located in planes that are disposed in generally horizontal orientations.

The twisted foot support members 208*a* and 208*b* include a top faces 224*a* and 224*b*, respectively. Twisted foot support members 208*a* and 208*b* further include bottom faces 226*a* and 226*b*, respectively. Accordingly, the first foot support portion 210*a*, the second foot support portion 212*a*, and the third foot support portion 214*a* of the twisted foot support member 108*a* may share a common face, e.g., the top face 224*a* and/or the bottom face 226*a*. As seen in FIGS. 5-8, the common top face 224*a* and the common bottom face 226*a* extend continuously across the first foot support portion 210*a*, the second foot support portion 212*a*, the third foot support portion 214*a*, and the twist portion 216*a*. Likewise, the first foot support portion 210*b*, the second foot support portion 212*b*, and the third foot support portion 214*b* of the twisted foot support member 208*b* may also share a common face, e.g., the top face 224*b* and/or the bottom face 226*b*. The common top face 224*b* and the common bottom face 226*b* may similarly extend continuously across the first foot support portion 210*b*, the second foot support portion 212*b*, the third foot support portion 214*b*, and the twist portion 216*b*.

At the third foot support portions 214*a* and 214*b* disposed in a generally horizontal orientation, the top faces 224*a* and 224*b* face upward toward a plantar surface of a foot (i.e., toward the footbed portion), and the bottom faces 226*a* and 226*b* face downward away from the plantar surface of a foot (i.e., away from the footbed portion). At the second foot support portions 212*a* and 212*b* disposed in a generally vertical orientation, the top faces 224*a* and 224*b* face inward toward each other, and the bottom faces 226*a* and 226*b* face outward away from each other. Accordingly, it can be seen that the twist portions 216*a* and 216*b* twist in opposite directions. In this example, when observing the shoe 202 from the front, the twist portion 216*a* twists from the first foot support portion 210*a* to the third foot support portion 214*a* in a counterclockwise direction and the twist portion 216*b* twists from the first foot support portion 210*b* to the third foot support portion 214*b* in a clockwise direction. As described above, the first foot support portions 210*a* and 210*b* are also disposed in a generally horizontal orientation. Because of the half twist provided by the respective twist portions 216*a* and 216*b*, in this example, the top faces 224*a* and 224*b* face downward away from the plantar surface of a foot (i.e., away from the footbed portion) at the first foot support portions 210*a* and 210*b*, and the bottom faces 226*a* and 226*b* face upward toward the plantar surface of a foot (i.e., toward the footbed portion) at the first foot support portions.

It will be appreciated that, in other embodiments, alternative configurations for the twist portion may be selectively employed so as to alternatively configure the top and bottom faces of a twisted support member. For example, the twist portion may twist such that the top faces 224*a* and 224*b* face outward away from each other, and the bottom faces 226*a* and 226*b* face inward toward from each other at the second foot support portions 212*a* and 212*b* disposed in a generally vertical orientation. As another example, the twist portion may twist such that the top faces 224*a* and 224*b* face upward toward the plantar surface of the foot and such that the bottom faces 226*a* and 226*b* face downward away from the plantar surface of the foot at the first foot support portions 210*a* and 210*b* and at the third foot support portions 214*a* and 214*b* disposed in a generally horizontal orientation. In further examples, various combinations of the configurations described above may be selectively employed.

The twisted foot support members 208*a* and 208*b* are joined together in a contiguous, unitary construction in this example foot support structure 200. In other words, the first foot support portion 210*a*, the second foot support portion 212*a*, the third foot support portion 214*a*, and the twist portion 216*a* of the twisted foot support member 208*a* are one integral piece in this example foot support structure 200. Likewise, the first foot support portion 210*b*, the second foot support portion 212*b*, the third foot support portion 214*b*, and the twist portion 216*b* of the twisted foot support member 208*b* are one integral piece in this example foot support structure 200. Moreover, the third foot support portion 214*a* of the twisted foot support member 208*a* and the foot support portion 214*b* of the twisted foot support member 208*b* are each contiguous with the third heel support plate 206 of the foot support structure 200. In this way, the heel support plate 206 joins the foot support member 208*a* with the foot support member 208*b*. The twisted foot support members 208*a* and 208*b* branch off from a bifurcation 228 at the heel support plate 206. In other words, the heel support plate 206, the foot support member 208*a*, and the foot support member 208*b* form a unitary, one-piece construction in this example foot support structure 200.

From the heel support plate 206, at least a portion of the twisted foot support member 208*a* extends along a lateral edge 230 of the foot support structure 200, and at least a portion of the twisted foot support member 208*b* extends along a medial edge 232 of the foot support structure. In this way, the twisted foot support members 208*a* and 208*b* decouple the lateral side of a shoe (or other foot-receiving device) from the medial side of the shoe (or other foot-receiving device) to provide for more natural pronation as discussed above.

The twisted foot support members 208*a* and 208*b*, in this example, each include a respective pad 234*a* and 234*b*. As seen in FIGS. 5-8, the pads 234*a* and 234*b* respectively extend from the first foot support portions 210*a* and 210*b* toward the forefoot region 218 of the foot support structure 200. Additionally, each pad 234*a* and 234*b* engages the forefoot support plate 204. The pads 234*a* and 234*b* may, for example, be integral with the forefoot support plate 204. The pads 234*a* and 234*b* may alternatively, for example, be attached to the forefoot support plate (e.g., glued). In this way, the twisted foot support members 208*a* and 208*b* engage the forefoot support plate via the respective pads 234*a* and 234*b*. The pads 234*a* and 234*b*, in this example, have a generally oblong shape and respectively engage the forefoot support plate 204 at the lateral edge 230 and the medial edge 232 of the foot support structure 200.

Figure 9:
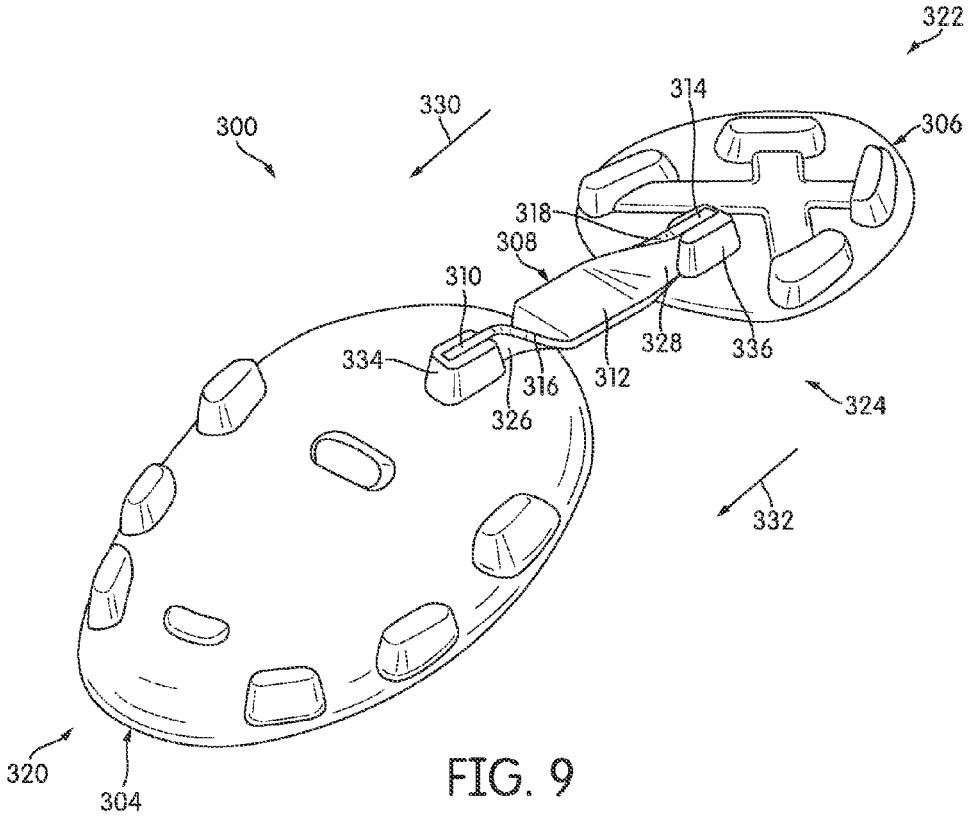
FIGS. 9-12 show a third embodiment of a foot support structure.
Figure 10:
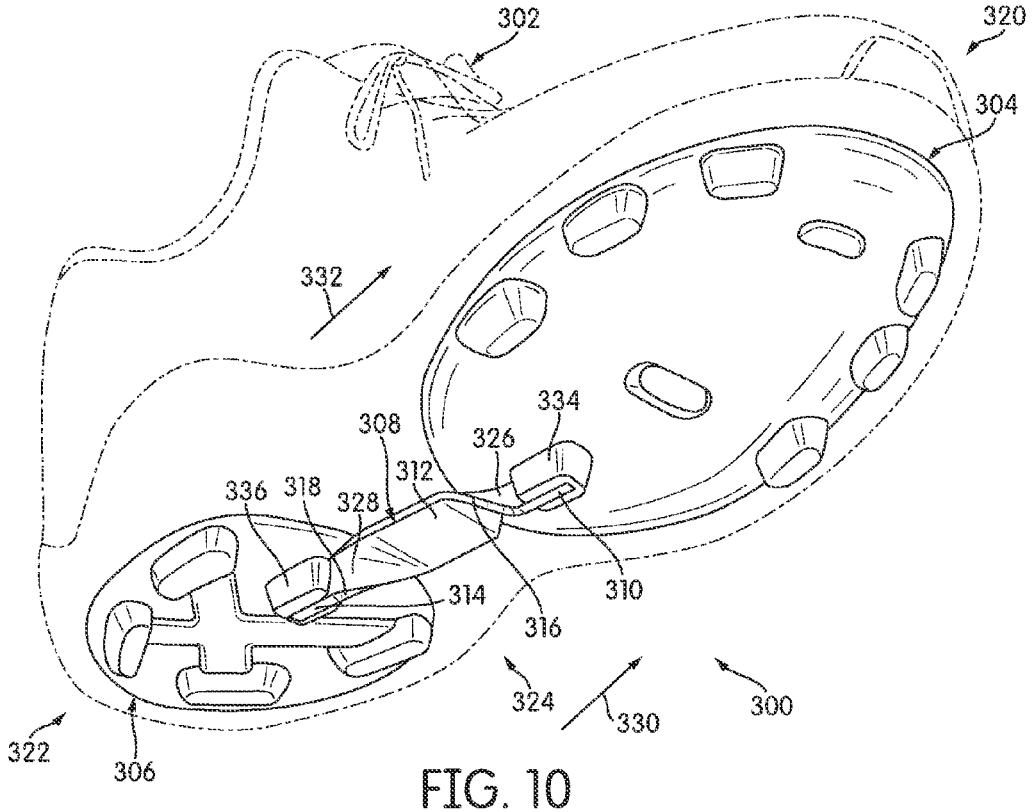
Figure 11:
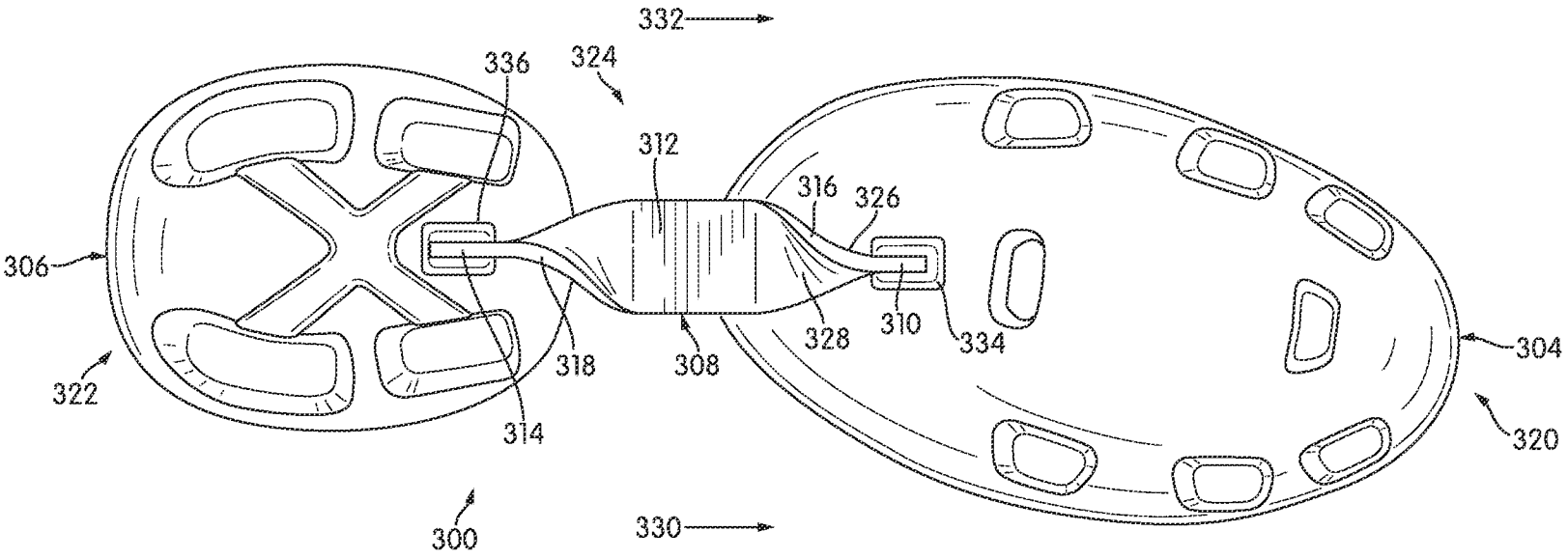
Figure 12:
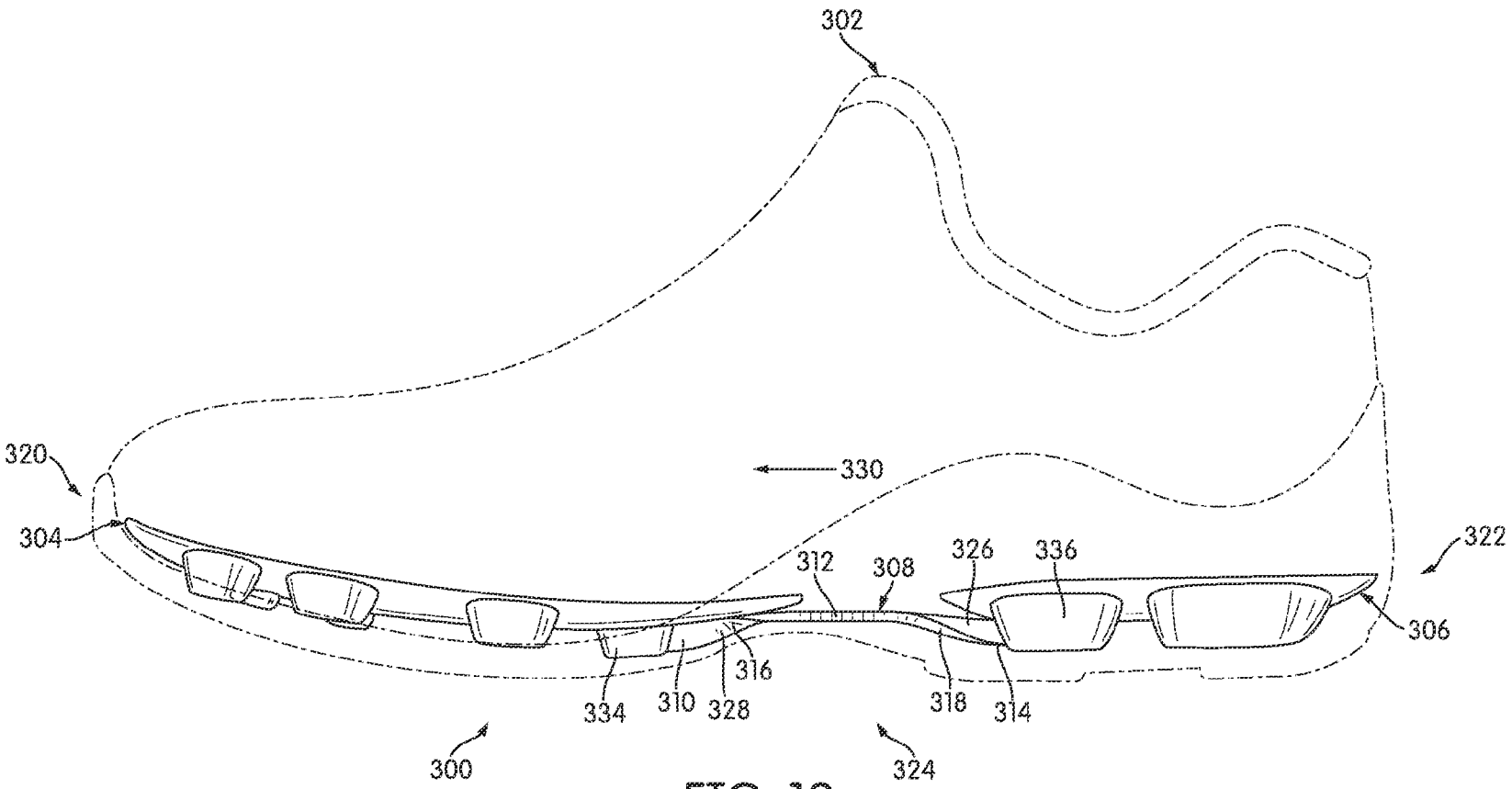

FIGS. 9-12 show a foot support structure 300 according to a third embodiment. FIG. 9 is an inverted perspective view of the foot support structure 300. FIG. 10, is a bottom perspective view of the foot support structure 300 incorporated into an article of footwear 302 (shown in uneven broken lines). FIG. 11 is a bottom-up view of the foot support structure 300. FIG. 12, is a side view of the foot support structure 300 incorporated into the article of footwear 302.

As seen in FIGS. 9-12, the example foot support structure 300 includes a forefoot support plate 304, a heel support plate 306, and a twisted foot support member 308. The twisted foot support member 308 includes a first foot support portion 310, a second foot support portion 312, and a third foot support portion 314. The twisted foot support member 308, in this example, also includes a first twist portion 316 and a second twist portion 318. The forefoot support plate 304 is located in a forefoot region 320 of the foot support structure 300. The heel support plate 306 is located in a heel region 322 of the foot support structure 300. The twisted foot support member 308 extends through a midfoot region 324 of the foot support structure 300 and engages both the forefoot support plate 304 and the heel support plate 306. More specifically, the first foot support portion 310 engages the forefoot support plate 304, and the third foot support portion 314 engages the heel support plate 306. Accordingly, the second foot support portion 312 as well as the first twist portion 316 and the second twist portion 318 are positioned between the first foot support portion 310 and the third foot support portion 314 and are located in the midfoot region 324 of the foot support structure 300. More specifically, in this example foot support structure 300, the first twist portion 316 is positioned between the first foot support portion 310 and the second foot support portion 312; the second foot support portion is positioned between the first twist portion 316 and the second twist portion 318; and the second twist portion is positioned between the second foot support portion 312 and the third foot support portion 314. Further, the twisted foot support member 308, in this example, extends from the forefoot support plate 304 to the heel support plate 306 along a midline of the foot support structure 300. The first foot support portion 310, the second foot support portion 312, the third foot support portion 314, the first twist portion 316, and the second twist portion 318 of the foot support member 308 are one integral piece in this example foot support structure 300.

The first foot support portion 310 and the third foot support portion 314 are disposed in a first orientation, which in this example is generally vertical relative to a plantar surface of a foot. The second foot support portion 312 is disposed in a second orientation different than the first orientation, which in this example is generally horizontal relative to a plantar surface of a foot. The first twist portion 316 extends continuously from the first foot support portion 310 to the second foot support portion 312. The second twist portion 318 extends continuously from the third foot support portion 314 to the second foot support portion 312. Accordingly, the first twist portion 316 is located near the forefoot support plate 304, and the second twist portion is located near the heel support plate 306 as shown by way of example in the foot support structure 300 of FIGS. 9-12. Between the first foot support portion 310 and the second foot support portion 312, the first twist portion 316 twists from the first orientation to the second orientation, which in this example is a twist from a generally vertical orientation to a generally horizontal orientation. Between the second foot support portion 312 and the third foot support portion 314, the second twist portion 318 twists from the second orientation back to the first orientation, which in this example is a twist from a generally horizontal orientation to a generally vertical orientation. The twisting of the first and second twist portions 316 and 318, in this example, may each be referred to as a "quarter-twist" in that each of the twist portions twist approximately 90°. In this way, the foot support structure 300 provides areas of relative stiffness in the forefoot region 320 where the first foot support portion 310 joins the forefoot support plate 304 and in the heel region 322 where the third foot support portion 314 joins the heel support plate 306. The foot support structure 300 also provides an area of relative flexibility in the midfoot region 324 due to the orientation of the second foot support portion 312. The second foot support portion 312, in this example, is disposed in a generally horizontal orientation. Axes about which the second foot support portion 312 has less resistance to bending are located in a plane that is also disposed in generally horizontal orientation. For example, that axis for the second foot support portion 312 lies in a plane that passes through edges of the second foot support portion 312. Axes about which the first foot support portion 310 and the third foot support portion 314 have less resistance to bending are located in planes that are disposed in generally vertical orientations. For example, that axis for the first foot support portion 310 lies in a plane that passes through edges of the first foot support portion 310. Consequently, axes about which the first foot support portion 310 and the third foot support portion 314 have more resistance to bending are located in planes that are disposed in generally horizontal orientations.

The twisted foot support member 308 includes a top face 326 and a bottom face 328. Accordingly, the first foot support portion 310, the second foot support portion 312, and the third foot support portion 314 of the twisted foot support member 308 may share a common face, e.g., the top face 326 and/or the bottom face 328. As seen in FIGS. 9-12, the common top face 326 and the common bottom face 328 extend across the first foot support portion 310, the second foot support portion 312, the third foot support portion 314, the first twist portion 316, and the second twist portion 318. As seen in FIGS. 9-12, the first twist portion twists 316 in a first direction and the second twist portion 318 twists in a second direction opposite the first direction. In this example, when observing the shoe 302 from the front, the twist portion 316 twists from the first foot support portion 310 to the second foot support portion 312 in a clockwise direction and the twist portion 318 twists from the second foot support portion 312 to the third foot support portion 314 also in a clockwise direction. In this example, the first twist portion 316 twists such that, at the first foot support portion 310 disposed in the generally vertical orientation, the bottom face 328 faces a medial edge 330 of the foot support structure 300 and the top face 326 faces a lateral edge 332 of the foot support structure. Comparatively, the second twist portion 318 twists such that, at the third foot support portion also disposed in the generally vertical orientation, the bottom face 328 faces the lateral edge 332 of the foot support structure 300 and the top face 326 faces the medial edge 330 of the foot support structure. At the second foot support portion 312, the top face 326 may face upward toward the plantar surface of a foot, and the bottom face 328 may face downward away from the plantar surface of a foot.

It will be appreciated that, in other embodiments, alternative configurations for the twist portions 316 and 318 may be selectively employed so as to alternatively configure the top and bottom faces of a twisted support member. For example, the twist portion 316 may twist such that the top face 326 faces the medial edge 330 and the bottom face 328 faces the lateral edge 332 at the first foot support portion 310 disposed in a generally vertical orientation. As another example, the twist portion 318 may twist such that the top face 326 faces the lateral edge 332 and the bottom face 328 faces the medial edge 330 at the third foot support portion 314 also disposed in a generally vertical orientation. In additional examples, the twist portion 316 and the twist portion 318 may twist in the same direction rather than opposite directions (e.g., both clockwise or both counterclockwise). In these additional examples, the top face 326 at the first and third foot support portions 310 and 314 would face a common side of the foot support structure as would the bottom face 328 at the first and third foot support portions. In further embodiments, various combinations of the configurations described above may be selectively employed.

The foot support structure 300, in this example, also includes one or more cleats 334 and 336. Cleat 334, in this example, is mounted to the forefoot support plate 304. Cleat 336, in this example, is mounted to the heel support plate 306. The cleats 334 and 336 may be respectively mounted to the forefoot support plate 304 and the heel support plate 306 near the midline of the foot support structure 300. Accordingly, the cleats 334 and 336 may be configured to receive and support the twisted foot support members 308. More particularly, the first foot support portion 310 may engage the cleat 334 mounted to the forefoot support plate 304, and the third foot support portion 314 may engage the cleat 336 mounted to the heel support plate 306.

It will be appreciated that alternative embodiments may exhibit alternative configurations for the twisted foot support member. As an example, in alternative embodiments the first and third foot support portions 310 and 314 may be disposed in a generally horizontal orientation relative to the plantar surface of a foot and the second foot support portion 312 may be disposed in a generally vertical orientation relative to the plantar surface of a foot. In these alternative embodiments, the first and third foot support portions 310 and 314 may respectively engage the forefoot support plate 304 and the heel support plate 306 without using cleats.

Figure 13:
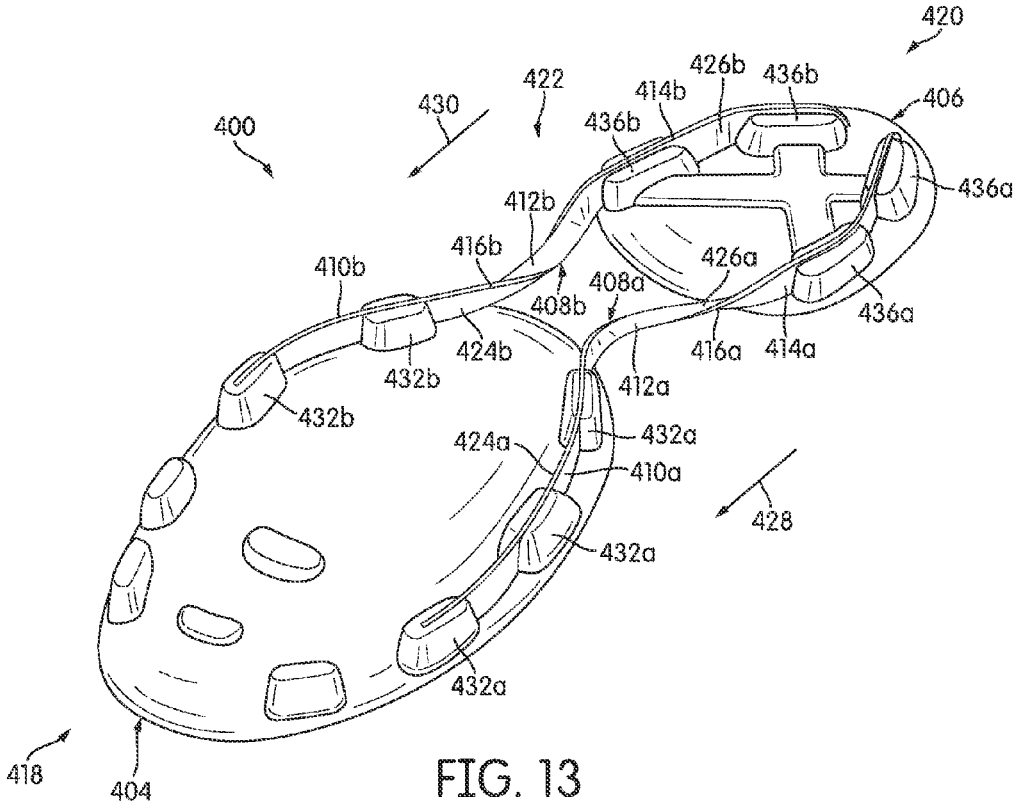
FIGS. 13-16 show a fourth embodiment of a foot support structure.
Figure 14:
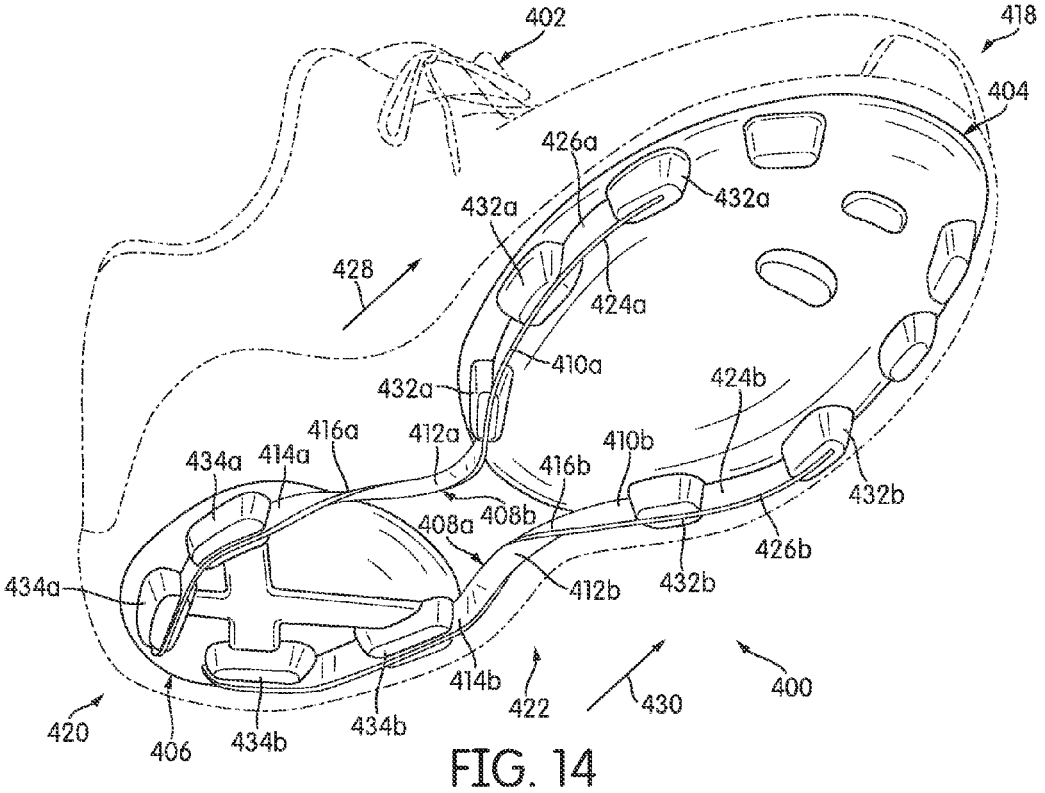
Figure 15:
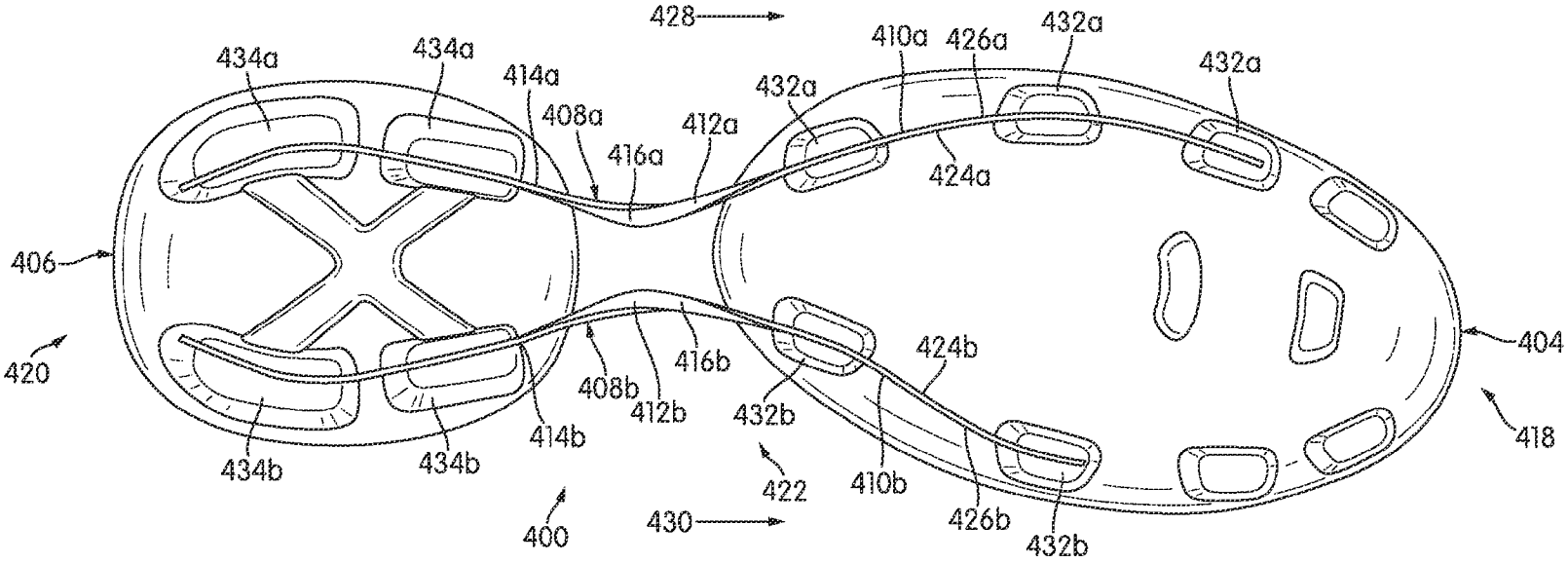
Figure 16:
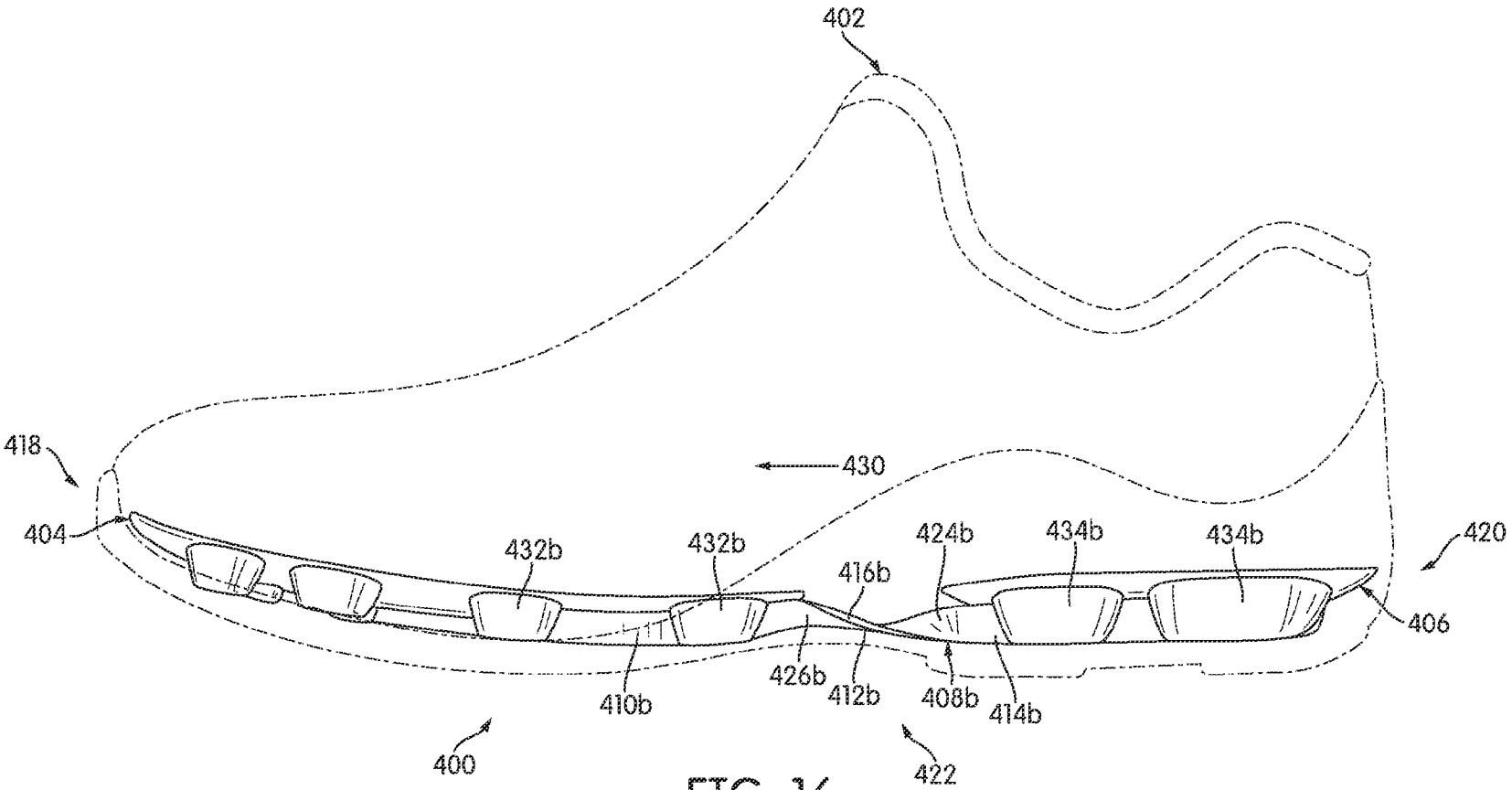

FIGS. 13-16 show a foot support structure 400 according to a fourth embodiment. FIG. 13 is an inverted perspective view of the foot support structure 400. FIG. 14 is a bottom perspective view of the foot support structure 400 incorporated into an article of footwear 402 (shown in uneven broken lines). FIG. 15 is a bottom-up view of the foot support structure 400. FIG. 16 is a side view of the foot support structure 400 incorporated into the article of footwear 402.

As seen in FIGS. 13-16, the example foot support structure 400 includes a forefoot support plate 404, a heel support plate 406, and pair of twisted foot support members 408*a* and 408*b*. The twisted foot support member 408*a* includes a first foot support portion 410*a*, a second foot support portion 412*a*, and third foot support portion 414*a*, and a twist portion 416*a*. Likewise, the second foot support portion 408*b* includes a first foot support portion 410*b*, a second foot support portion 412*b*, a third foot support portion 414*b*, and a twist portion 416*b*. The forefoot support plate 404 is located in a forefoot region 418 of the foot support structure 400. The heel support plate 406 is located in a heel region 420 of the foot support structure 400. The twisted foot support members 408*a* and 408*b* extend through a midfoot region 422 of the foot support structure 400 and engage both the forefoot support plate 404 and the heel support plate 406. More specifically, the first foot support portions 410*a* and 410*b* engage the forefoot support plate 404, and the third foot support portions 414*a* and 414*b* engage the heel support plate 406. Accordingly, the second foot support portion 412*a* and the twist portion 416*a* of the twisted foot support member 408*a* is positioned between the first foot support portion 410*a* and the third foot support portion 414*a* and are located in the midfoot region 422 of the foot support structure 400.

The first foot support portions 410*a* and 410*b* and the third foot support portions 414*a* and 414*b* are disposed in a first orientation, which in this example is generally vertical relative to a plantar surface of a foot. The second foot support portions 412*a* and 412*b* are disposed in a second orientation different than the first orientation, which in this example is generally horizontal relative to a plantar surface of a foot. The twist portion 416*a* of the twisted foot support member 408*a* extends continuously from the first foot support portion 410*a* to the second foot support portion 412*a* as well as from the second foot support portion 412*a* to the third foot support portion 414*a*. Likewise, the twist portion 416*b* of the twisted foot support member 408*b* extends continuously from the first foot support portion 410*b* to the second foot support portion 412*b* as well as from the second foot support portion 412*b* to the third foot support portion 414*b*. Between the first foot support portion 410*a* and the second foot support portion 412*a*, the twist portion 416*a* twists from the first orientation to the second orientation, which is a twist from a generally vertical orientation to a generally horizontal orientation in this example. Between the second foot support portion 412*a* and the third foot support portion 414*a*, the twist portion twists from the second orientation back to the first orientation, which in this example is a twist from a generally horizontal orientation to a generally vertical orientation. The twist portion 416*b* of the foot support member 408*b* may likewise twist from the first orientation to the second orientation between the first foot support portion 410*b* and 412*b* and from the second orientation back to the first orientation between the second foot support portion 412*b* and the third foot support portion 414*b*. The twisting of the twist portions 416*a* and 416*b*, in this example, may be referred to as a "half twist" in that the twist portions twist approximately 180° (i.e., approximately 90° between the first foot support portion and the second foot support portion and again approximately 90° between the second foot support portion and the third foot support portion). In this way, the foot support structure 400 provides areas of relative stiffness in the forefoot region 418 where the first foot support portions 410*a* and 410*b* join the forefoot support plate 404 and in the heel region 420 where the third foot support portions 414*a* and 414*b* join the heel support plate 406. The foot support structure 400 also provides an area of relative flexibility in the midfoot region 422 due to the orientation of the second foot support portions 412*a* and 412*b*. The second foot support portions 412*a* and 412*b*, in this example, are disposed in a generally horizontal orientation. Axes about which each of the second foot support portions 412*a* and 412*b* have less resistance to bending are located in planes that are also disposed in generally horizontal orientations. For example, that axis for the second foot support portion 412*a* lies in a plane that passes through edges of the second foot support portion 412*a*. Axes about which each of the first foot support portions 410*a*/410*b* and the third foot support portions 414*a*/414*b* have less resistance to bending are located in planes that are disposed in generally vertical orientations. For example, that axis for the first foot support portion 410*a* lies in a plane that passes through edges of the first foot support portion 410*a*. Consequently, axes about which each of the first foot support portions 410*a*/410*b* and the third foot support portions 414*a*/414*b* have more resistance to bending are located in planes that are disposed in generally horizontal orientations.

The twisted foot support members 408*a* and 408*b* each include top faces 424*a* and 424*b*, respectively. Twisted foot support members 408*a* and 408*b* further include bottom faces 426*a* and 426*b*, respectively. Accordingly, the first foot support portion 410*a*, the second foot support portion 412*a*, and the third foot support portion 414*a* of the twisted foot support member 408*a* may share a common face, e.g., the top face 424*a* and/or the bottom face 426*a*. As seen in FIGS. 13-16, the common top face 424*a* and the common bottom face 426*a* extend continuously across the first foot support portion 410*a*, the second foot support portion 412*a*, the third foot support portion 414*a*, and the twist portion 416*a*. Likewise, the first foot support portion 410*b*, the second foot support portion 412*b*, and the third foot support portion 414*b* of the twisted foot support member 408*b* may also share a common face, e.g., the top face 424*b* and/or the bottom face 426*b*. The common top face 424*b* and the common bottom face 426*b* may similarly extend continuously across the first foot support portion 410*b*, the second foot support portion 412*b*, the third foot support portion 414*b*, and the twist portion 416*b*.

At the third foot support portions 414*a* and 414*b* disposed in a generally vertical orientation, the top faces 424*a* and 424*b* face outward and away from each other, and the bottom faces 426*a* and 426*b* face inward toward each other. At the second foot support portions 412*a* and 412*b* disposed in a generally horizontal orientation, the top faces 424*a* and 424*b* face upward toward the plantar surface of a foot (i.e., toward the footbed portion), and the bottom faces 426*a* and 426*b* face downward away from the plantar surface of a foot (i.e., away from the footbed portion). Accordingly, it can be seen that the twist portions 416*a* and 416*b* twist in opposite directions In this example, when observing the shoe 402 from the front, the twist portion 416*a* twists from the first foot support portion 410*a* to the third foot support portion 414*a* in a counterclockwise direction and the twist portions 416*b* twists from the first foot support portion 410*b* to the third foot support portion 414*b* in a clockwise direction. As described above, the first foot support portions 410*a* and 410*b* are also disposed in a generally vertical orientation. Because of the half twist provided by the respective twist portions 416*a* and 416*b*, in this example, the top faces 424*a* and 424*b* face inward toward each other at the first foot support portions 410*a* and 410*b*, and the bottom faces 426*a* and 426*b* face outward away from each other at the first foot support portions.

It will be appreciated that, in other example embodiments, alternative configurations for the twist portion may be selectively employed so as to alternatively configure the top and bottom faces of a twisted support member. For example, the twist portion may twist such that the top faces 424*a* and 424*b* face inward toward each other, and the bottom faces 426*a* and 426*b* face outward away from each other at the third foot support portions 412*a* and 412*b* disposed in a generally vertical orientation. As another example, the twist portion may twist such that the top faces 424*a* and 424*b* face outward away from each other and such that the bottom faces 426*a* and 426*b* face inward toward each other at the first foot support portions 410*a* and 410*b* disposed in a generally horizontal orientation. In further examples, various combinations of the configurations described above may be selectively employed.

The twisted foot support members 408*a* and 408*b* are separate elements in the example foot support structure 400 of FIGS. 13-16. Each individual twisted foot support members

408*a* and 408*b* may be one integral piece in this example foot support structure 400. In other words, the first foot support portion 410*a*, the second foot support portion 412*a*, the third foot support portion 414*a*, and the twist portion 416*a* of the twisted foot support member 408*a* are one integral piece in this example foot support structure 400. Likewise, the first foot support portion 410*b*, the second foot support portion 412*b*, the third foot support portion 414*b*, and the twist portion 416*b* of the twisted foot support member 408*b* are one integral piece in this example foot support structure 400. From the heel support plate 406, at least a portion of the twisted foot support member 408*a* extends along a lateral edge 428 of the foot support structure 400, and at least a portion of the twisted foot support member 408*b* extends along a medial edge 430 of the foot support structure. In this way, the twisted foot support members 408*a* and 408*b* decouple the lateral side of a shoe (or other foot-receiving device) from the medial side of the shoe (or other foot-receiving device) to provide for more natural pronation as discussed above.

The foot support structure 400, in this example, also includes one or more cleats 432*a*, 434*a*, 432*b*, and 434*b*. More particularly, the foot support structure includes cleats 432*a* and 432*b* mounted to the forefoot support plate as well as cleats 434*a* and 434*b* mounted to the heel support plate 406. The cleats 432*a* may be mounted to the forefoot support structure 404 near the lateral edge 428 of the foot support structure 400. The cleats 432*b* may be mounted to the heel support plate 406 near the medial edge of the foot support structure 400. Similarly, the cleats 434*a* may be mounted to the heel support plate 406 near the lateral edge 428 of the foot support structure 400, and the cleats 434*b* may be mounted to the heel support plate 406 near the medial edge 130 of the foot support structure. The cleats 432*a* and 434*a* may be configured to receive and support the twisted foot support member 408*a*. Similarly, the cleats 432*b* and 434*b* may be configured to receive and support the twisted foot support member 408*b*. Accordingly, the twisted foot support member 408*a* engages the forefoot support plate 404 and the heel support plate 406 by engaging the cleats 432*a* and 434*a* mounted to the forefoot support plate and the heel support plate respectively. Similarly, the twisted foot support member 408*b* engages the forefoot support plate 404 and the heel support plate 406 by engaging the cleats 432*b* and 434*b* mounted to the forefoot support plate and the heel support plate respectively. In this configuration, the twisted foot support members 408*a* and 408*b* may or may not connect directly to the heel support plate 406. For example, the heel support plate 406, the twisted foot support members 408*a* and 408*b*, and the cleats 432*a-b* and 434*a-b* may be one integrally molded piece. In another example, the heel support plate 406, the twisted foot support members 408*a* and 408*b*, and the cleats 432*a-b* and 434*a-b* may be separate pieces attached together (e.g., glued).

Figure 17:
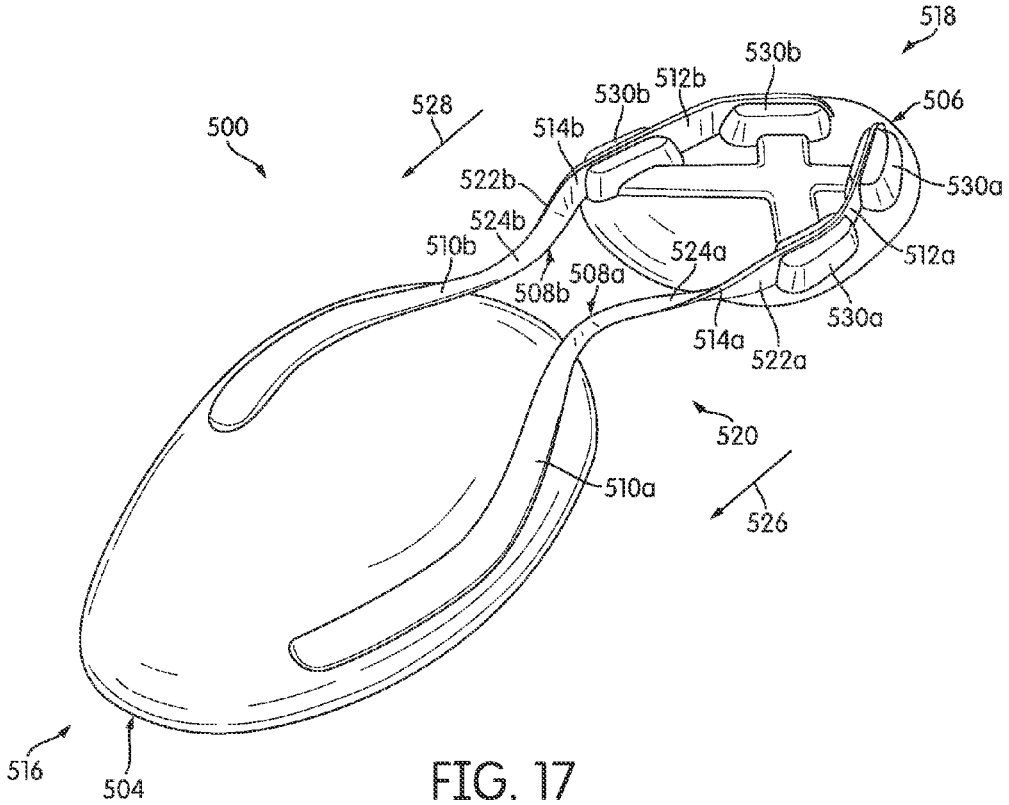
FIGS. 17-20 show a fifth embodiment a foot support structure.
Figure 18:
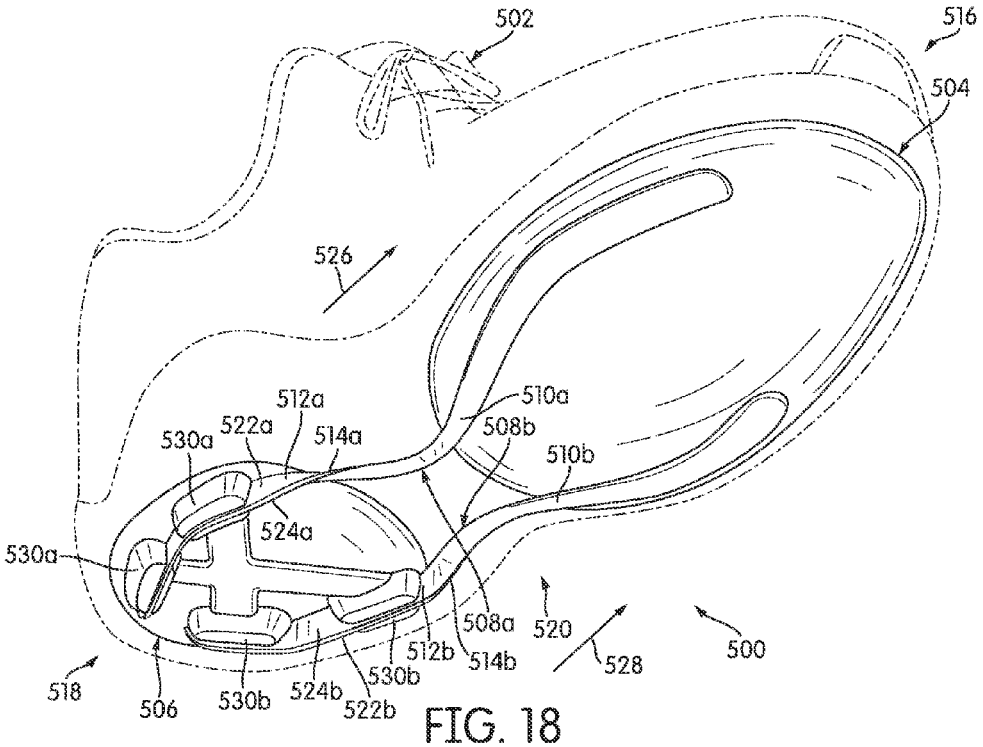
Figure 19:
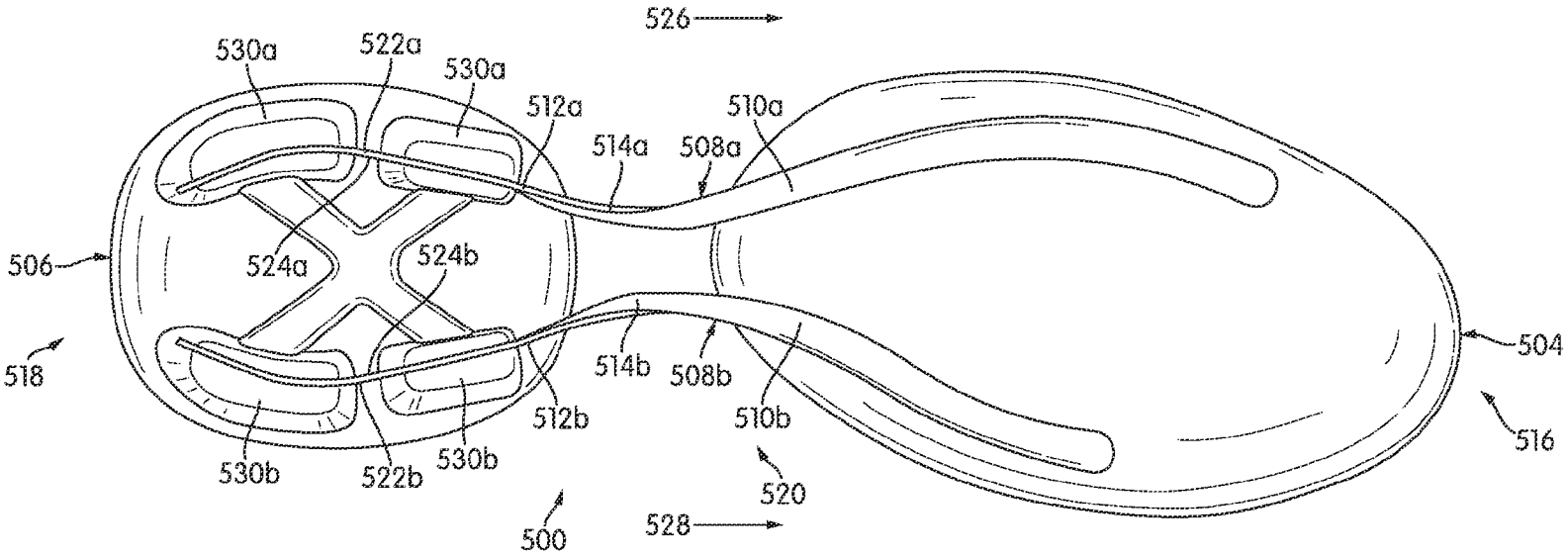
Figure 20:
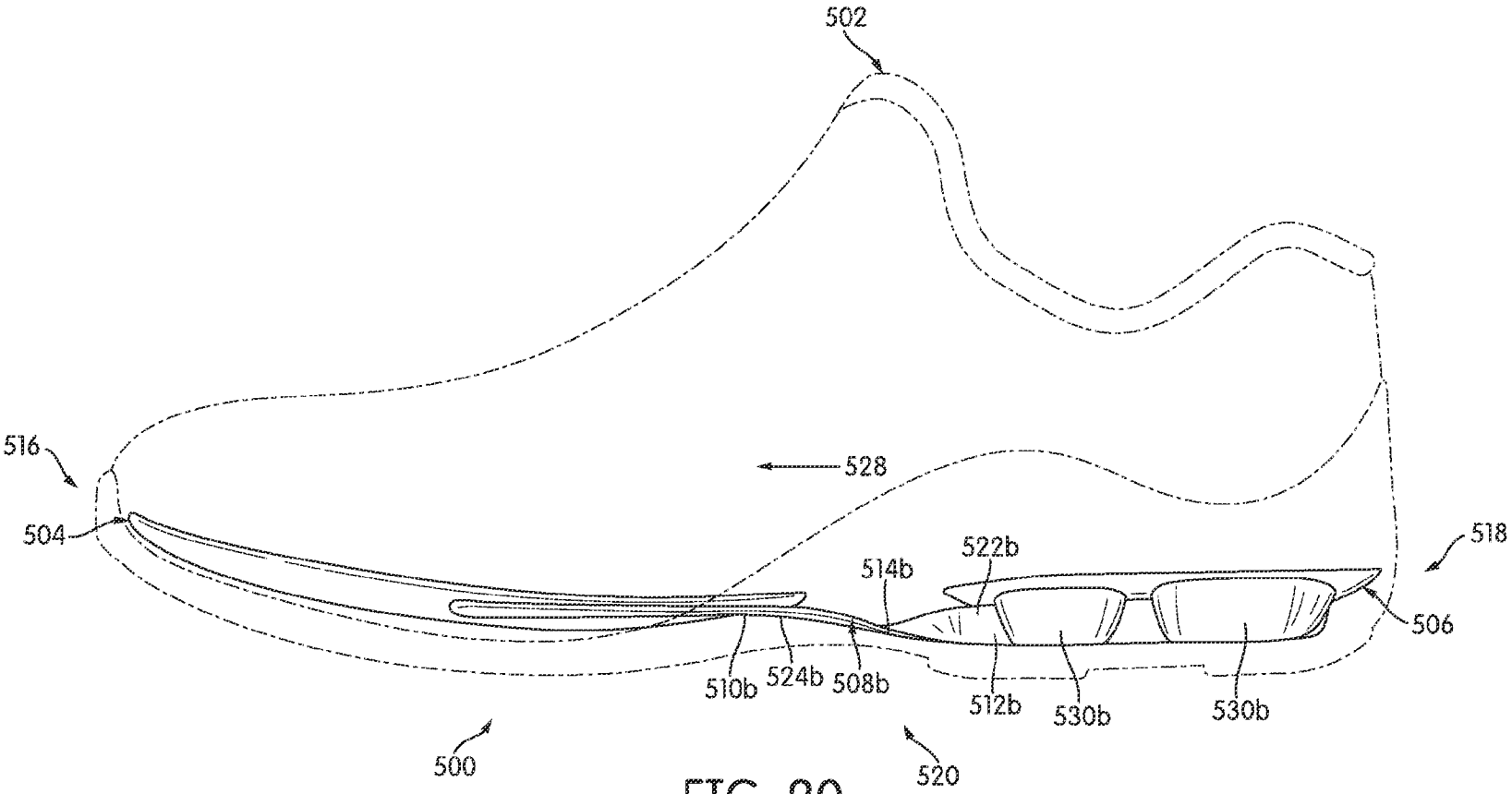

FIGS. 17-20 show a foot support structure 500 according to a fifth embodiment. FIG. 17 is an inverted perspective view of the foot support structure 500. In FIG. 18, is a bottom perspective view of the foot support structure 500 incorporated into an article of footwear 502 (shown in uneven broken lines). FIG. 19 is a bottom view of the foot support structure 500. FIG. 20 is a side view of the foot support structure 500 incorporated into the article of footwear 502.

As seen in FIGS. 17-20, the example foot support structure 500 includes a forefoot support plate 504, a heel support plate 506, and pair of twisted foot support members 508*a* and 508*b*. The twisted foot support member 508*a* includes a first foot support portion 510*a*, a second foot support portion 512*a*, and a twist portion 514*a*. Likewise, the second foot support portion 508*b* includes a first foot support portion 510*b*, a second foot support portion 512*b*, and a twist portion 514*b*. The forefoot support plate 504 is located in a forefoot region 516 of the foot support structure 500. The heel support plate 506 is located in a heel region 518 of the foot support structure 500. The twisted foot support members 508*a* and 508*b* extend through a midfoot region 520 of the foot support structure 500 and engage both the forefoot support plate 504 and the heel support plate 506. More specifically, the first foot support portions 510*a* and 510*b* engage the forefoot support plate 504, and the second foot support portions 512*a* and 512*b* engage the heel support plate 506. Accordingly, the twist portion 514*a* of the twisted foot support member 508*a* is positioned between the first foot support portion 510*a* and the second foot support portion 512*a* and is located in the midfoot region 520 of the foot support structure 500. Similarly, the twist portion 514*b* of the twisted foot support member 508*b* is positioned between the first foot support portion 510*b* and the second foot support portion 512*b* and is located in the midfoot region 520 of the foot support structure 500.

The first foot support portions 510*a* and 510*b* are disposed in a first orientation, which in this example is generally horizontal relative to a plantar surface of a foot. The second foot support portions 512*a* and 512*b* are disposed in a second orientation different than the first orientation, which in this example is generally vertical relative to a plantar surface of a foot. The twist portion 514*a* of the twisted foot support member 508*a* extends continuously from the first foot support portion 510*a* to the second foot support portion 512*a*. Likewise, the twist portion 514*b* of the twisted foot support member 508*b* extends continuously from the first foot support portion 510*b* to the second foot support portion 512*b*. The twist portions 514*a* and 514*b* also twist from the first orientation to the second orientation, which in this example is a twist from a generally horizontal orientation to a generally vertical orientation. Such a twist may be referred to as a "quarter-twist" in that the twist portion twists approximately 90°. In this way, the foot support structure 500 provides an area of relative flexibility in the forefoot region 516 where the first foot support portions 510*a* and 510*b* join the forefoot support plate 504 and an area of relative stiffness in the heel region 518 where the second foot support portions 512*a* and 512*b* join the heel support plate 502. The first foot support portions 510*a* and 510*b*, in this example, are disposed in a generally horizontal orientation. Axes about which each of the first foot support portions 510*a* and 510*b* have less resistance to bending are located in planes that are also disposed in generally horizontal orientations. For example, that axis for the first foot support portion 510*a* lies in a plane that passes through edges of the first foot support portion 510*a*. Axes about which each of the second foot support portions 512*a* and 512*b* have less resistance to bending are located in planes that are disposed in generally vertical orientations. For example, that axis for the second foot support portion 512*a* lies in a plane that passes through edges of the second foot support portion 512*a*. Consequently, axes about which each of the second foot support portions 512*a* and 512*b* have more resistance to bending are located in planes that are disposed in generally horizontal orientations.

The twisted foot support members 508*a* and 508*b* include top faces 522*a* and 522*b*, respectively. Twisted foot support members 508*a* and 508*b* further include bottom faces 524*a* and 524*b*, respectively. Accordingly, the first foot support portion 510*a* and the second foot support portion 512*a* of the twisted foot support member 508*a* may share a common face, e.g., the top face 522*a* and/or the bottom face 524*a*. As seen in FIGS. 17-20, the common top face 522*a* and the common bottom face 524*a* extend continuously across the first foot support portion 510*a*, the second foot support portion 512*a*, and the twist portion 514*a*. Likewise, the first foot support portion 510*b* and the second foot support portion 512*b* of the twisted foot support member 508*b* may also share a common face, e.g., the top face 522*b* and/or the bottom face 524*b*. The common top face 522*b* and the common bottom face 524*b* may similarly extend continuously across the first foot support portion 510*b*, the second foot support portion 512*b*, and the twist portion 514*b*.

At the first foot support portions 510*a* and 510*b* disposed in a generally horizontal orientation, the top faces 522*a* and 522*b* face upward toward a plantar surface of a foot (i.e., toward the footbed portion), and the bottom faces 524*a* and 524*b* face downward away from a plantar surface of a foot (i.e., away from the footbed portion). At the second foot support portions 512*a* and 512*b* disposed in a generally vertical orientation, the top faces 522*a* and 522*b* face outward away from each other, and the bottom faces 524*a* and 524*b* face inward toward from each other. Accordingly, it can be seen that the twist portions 514*a* and 514*b* twist in opposite directions. In this example, when observing the shoe 502 from the front, the twist portion 514*a* twists from the first foot support portion 510*a* to the second foot support portion 512*a* in a counterclockwise direction and the twist portion 514*b* twists from the first foot support portion 510*b* to the second foot support portion 512*b* in a clockwise direction.

It will be appreciated that, in other example embodiments, alternative configurations for the twist portion may be selectively employed so as to alternatively configure the top and bottom faces of a twisted support member. For example, the twist portion may twist such that the bottom faces 524*a* and 524*b* face outward away from each other and the top faces 522*a* and 522*b* face inward toward each other at the second foot support portions 512*a* and 512*b* disposed in a generally vertical orientation. In other examples, various combinations of the configurations described above may be selectively employed.

The twisted foot support members 508*a* and 508*b* are separate elements in the example foot support structure 500 of FIGS. 17-20. Each individual twisted foot support members 508*a* and 508*b* may be one integral piece in this example foot support structure 500. In other words, the first foot support portion 510*a*, the second foot support portion 512*a*, and the twist portion 514*a* of the twisted foot support member 508*a* are one integral piece in this example foot support structure 500. Likewise, the first foot support portion 510*b*, the second foot support portion 512*b*, and the twist portion 514*b* of the twisted foot support member 508*b* are one integral piece in this example foot support structure 500. From the heel support plate 506, at least a portion of the twisted foot support member 508*a* extends along a lateral edge 526 of the foot support structure 500, and at least a portion of the twisted foot support member 508*b* extends along a medial edge 528 of the foot support structure. In this way, the twisted foot support members 508*a* and 508*b* decouple the lateral side of a shoe (or other foot-receiving device) from the medial side of the shoe (or other foot-receiving device) to provide for more natural pronation as discussed above.

The foot support structure 500, in this example, also includes one or more cleats 530*a* and 530*b* mounted to the heel support plate 506. The cleats 530*a* may be mounted to the heel support plate 506 near the lateral edge 526 of the foot support structure 500. The cleats 530*b* may be mounted to the heel support plate 506 near the medial edge 528 of the foot support structure 500. The cleats 530*a* and 530*b* may be configured to receive and support the twisted foot support members 508*a* and 508*b* respectively. Accordingly, the twisted foot support member 508*a* engages the heel support plate 506 by engaging the cleats 530*a* mounted to the heel support plate. Similarly, the twisted foot support member 508*b* engages the heel support plate 506 by engaging the cleats 530*b* mounted to the heel support plate. As noted above with regards to FIGS. 1-4, the twisted foot support members 508*a* and 508*b* may or may not connect directly to the heel support plate 506. For example, the heel support plate 506, the twisted foot support members 508*a* and 508*b*, and the cleats 530*a* and 530*b* may be one integrally molded piece. In another example, the heel support plate 506, the twisted foot support members 508*a* and 508*b*, and the cleats 530*a* and 530*b* may be separate pieces attached together (e.g., glued).

Figure 21:
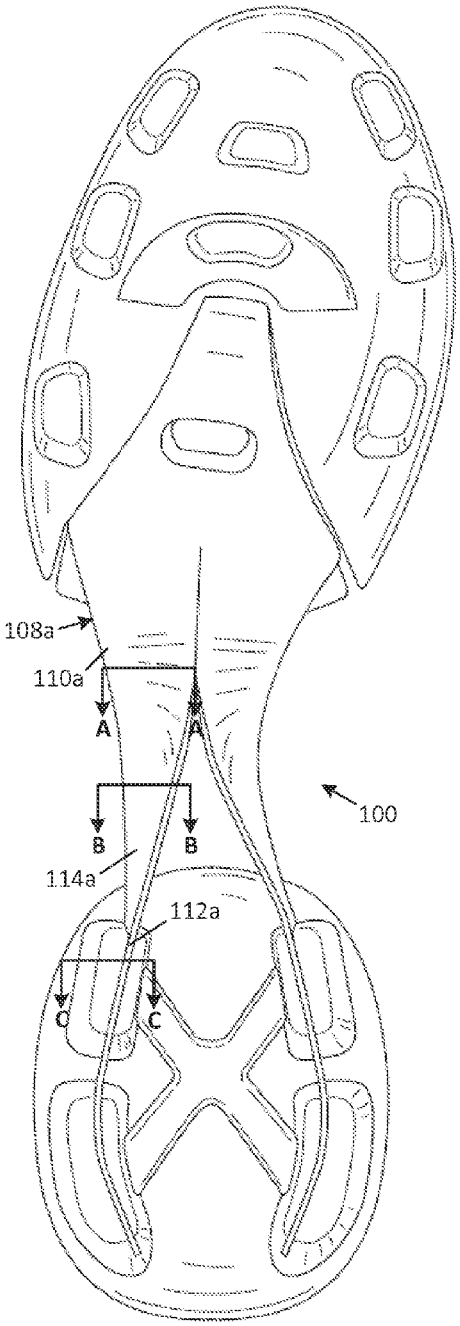
FIG. 21 another bottom view of the foot support structure of FIGS. 1-4.

FIG. 21 shows another bottom view of the foot support structure 100 of FIGS. 1-4. FIG. 21 shows locations of cross sections A-A, B-B, and C-C (of the first foot support portion 110*a*, the twist portion 114*a*, and the second foot support portion 112*a* respectively) that are discussed in further detail below with reference to FIG. 23.

Figure 22:
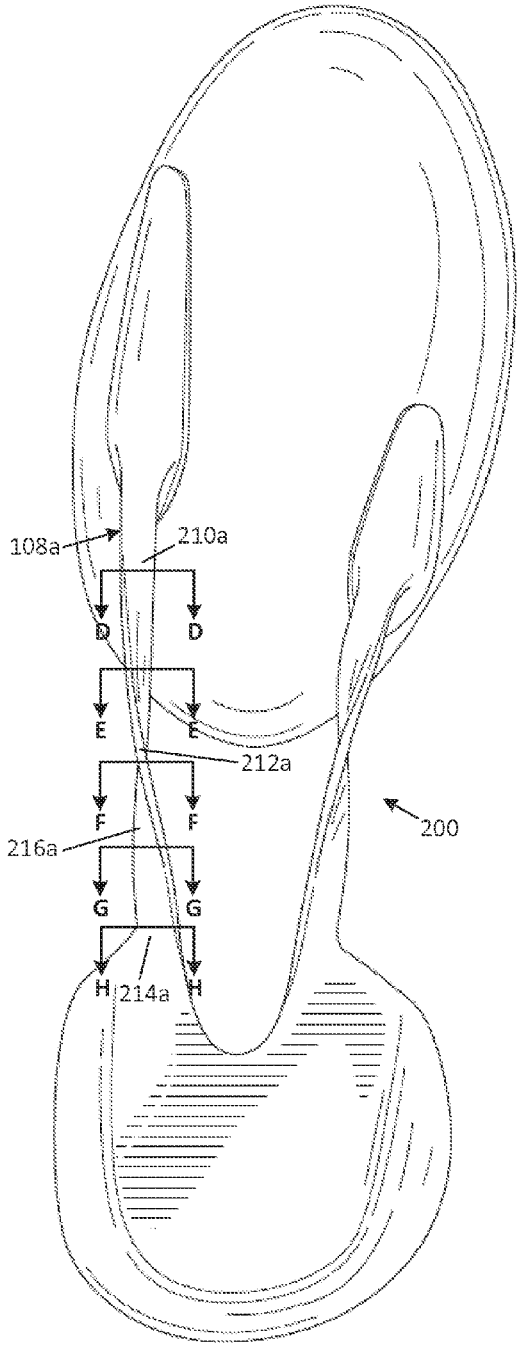
FIG. 22 another bottom view of the foot support structure of FIGS. 5-8.

FIG. 22 shows another bottom view of the foot support structure 200 of FIGS. 5-8. FIG. 22 shows locations of cross sections D-D, E-E, F-F, G-G, and H-H (of the first foot support portion 210*a*, a first location of the twist portion 216*a*, the second foot support portion 212*a*, a second location of the twist portion 216*a*, and the third foot support portion 214*a*) that are discussed in further detail below with reference to FIG. 24.

Figure 23:
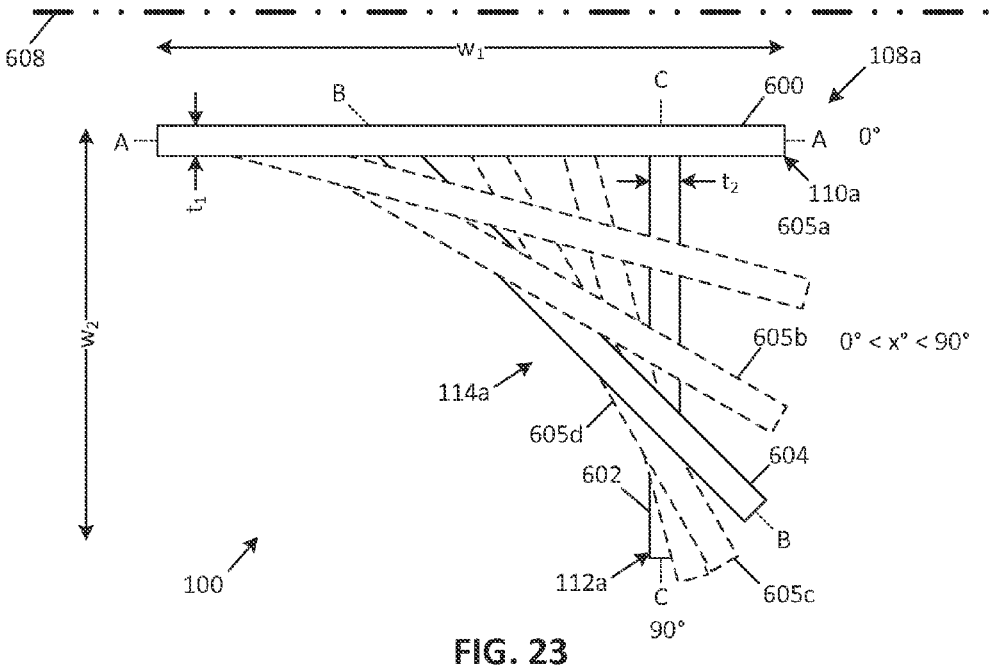
FIG. 23 is a series of cross sectional views taken from the locations indicated in FIG. 21.

FIG. 23 shows a series of area cross-sectional views of the twisted foot support member 108*a* superimposed on one another. The area cross section 600 of the first foot support portion 110*a* corresponds to line A-A in FIG. 21, the area cross section 602 of the second foot support portion 112*a* corresponds to line C-C in FIG. 21, and the area cross section 604 of the twist portion 114*a* corresponds to line B-B in FIG. 21. The area cross sections 605*a* and 605*b* are shown in broken lines for locations intermediate of A-A and B-B; and the area cross sections 605*c* and 605*d* are shown in broken lines for locations intermediate of B-B and C-C. The cross sections 600, 602, 604, and 605*a-d* of FIG. 23 illustrate how the twist portion twists, in this example, from the first foot support portion 110*a* disposed in the first orientation to the second foot support portion 112*a* disposed in the second orientation different from the first orientation. As seen in FIG. 23, the twist portion 114*a* twists from the first foot support portion 110*a* to the second foot support portion 112*a* in a clockwise direction when observed from the front.

As seen in FIG. 23, the cross section 600 of the first foot support portion 110*a*, the cross section 602 of the second foot support portion 112*a*, and the cross section 604 of the twist portion 114*a* may be substantially rectangular. It will be appreciated, however, that the cross sections 600, 602, and 604 may not be precisely rectangular. When incorporated into a foot-receiving device, the foot support structure 100 may be positioned below a plane 608, e.g., a plane generally corresponding to a footbed of the foot-receiving device.

As shown by the cross sections 600, 602, and 604 in FIG. 23, the twist portion 114*a* of the foot support structure 100 twists approximately 90° from the first foot support portion 110*a* to the second foot support portion 112*a*. Accordingly in this example, the cross section 600 of the first foot support portion 110*a* is disposed generally horizontal relative to the plane 608, the cross section 604 of the second foot support portion 112*a* is disposed generally vertical relative to the plane, and the cross section 606 of the twist portion 114*a* is disposed at an oblique angle relative to the plane.

As also shown by way of example in FIG. 23, the width of the foot support member 108*a* may vary along its length. As a result the width of the cross sections 600, 602, and 604 may also vary along the length of the foot support member 108*a*. For example, the first foot support portion 110*a* may be wider than the second foot support portion 112*a*. As a result, the cross section 600 of the first foot support portion 110*a* may have a width, $w_1$, that is greater than a width, $w_2$, of the second foot support portion 112*a* as shown by way of example in FIG. 23. The twist portion 114*a* may thus have a width that varies between $w_1$ and $w_2$ as the twist portion extends from the first foot support portion 110*a* to the second foot support portion 112*a*. It will be appreciated that, in some example embodiments, the second foot support portion 112*a* may have a width that is greater than the width of the first foot support portion 110*a*.

The thickness of the foot support member 108*a* may also vary along its length. As a result, the thickness of the cross sections 600, 602, and 604 may also vary along the length of the foot support member 108*a*. For example, the first foot support portion 110*a* may be thicker than the second foot support portion 112*a*. As a result, the cross section 600 of the first foot support portion 110*a* may have a thickness, $t_1$, that is greater than a thickness, $t_2$, of the second foot support portion 112*a* as shown by way of example in FIG. 23. The twist portion 114*a* may thus have a thickness that varies between $t_1$ and $t_2$ as the twist portion 114*a* extends from the first foot support portion 110*a* to the second foot support portion 112*a*. It will be appreciated that in some example embodiments, the second foot support portion 112*a* may have a thickness that is greater than the thickness of the first foot support portion 110*a*.

Figure 24:
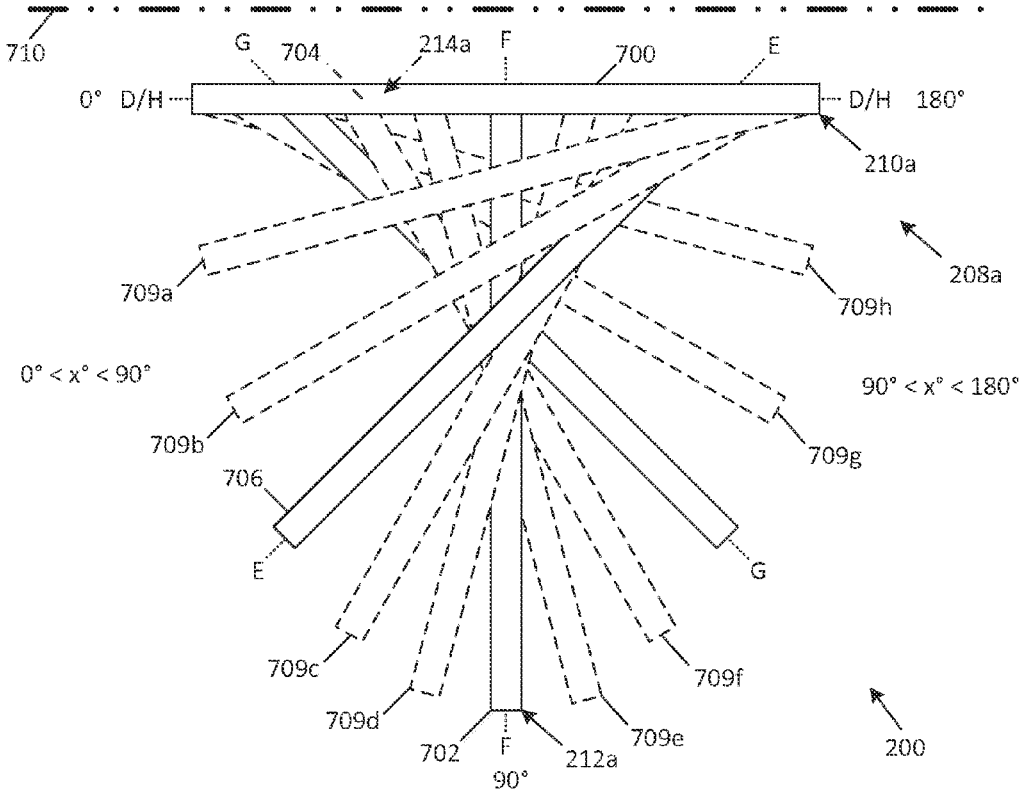
FIG. 24 is a series of cross sectional views taken from the locations indicated in FIG. 22.

FIG. 24 shows a series of area cross-sectional views of the twisted foot support member 208*a* superimposed on one another. The area cross section 700 of the first foot support portion 210*a* corresponds to line D-D in FIG. 22, the area cross section 702 of the second foot support portion 212*a* corresponds to line F-F in FIG. 22, the area cross section 704 of the third foot support portion 214*a* corresponds to line H-H in FIG. 22, the first area cross section 706 of the twist portion 216*a* corresponds to line E-E in FIG. 22, and the second area cross section 708 of the twist portion corresponds to line G-G in FIG. 22. It will be appreciated that, because the first foot support portion 210*a* and the third foot support portion 214*a* are disposed in a common orientation, the area cross section 706 corresponding to line H-H in FIG. 22 would be situated behind the cross section 700 in FIG. 24. The area cross sections 709*a* and 709*b* are shown in broken lines for locations intermediate of D-D and E-E; the area cross sections 709*c* and 709*d* are shown in broken lines for locations intermediate of E-E and F-F; the area cross sections 709*e* and 709*f* are shown in broken lines for locations intermediate of F-F and G-G; and the area cross sections 709*g* and 709*h* are shown in broken lines for locations intermediate of G-G and H-H. The cross sections 700, 702, 704, 706, 708, and 709*a-h* illustrate how the twists portion twists, in this example, from the first foot support portion 210*a* disposed in the first orientation to the second foot support portion 212*a* disposed in the second orientation different from the first orientation and to the third foot support portion 214*a* disposed in the first orientation. As seen in FIG. 24, the twist portion 216*a* twists in a counterclockwise direction.

As shown by the cross sections 700, 702, 704, 706, and 708 in FIG. 24, the twist portion 216*a* of the foot support structure twists approximately 180° from the first foot support portion 210*a* to the third foot support portion 214*a*. Accordingly in this example, the cross section 700 of the first foot support portion and the cross section 704 of the third foot support portion 214*a* are disposed generally horizontal relative to a plane 710 situated above the foot support structure 200 (e.g., a footbed of the foot-receiving device). The cross section 702 of the second foot support portion 212*a*, in this example, is disposed in a generally vertical orientation relative to the plane 710, and the cross sections 704 and 706 of the twist portion 216*a* are disposed at an oblique angle relative to the plane.

It will be appreciated that there may be alternative ways to understand and describe the twist portion of a foot support structure. As described above, the twist portion 216*a* of the foot support structure 200 shown in FIG. 24 may be described as twisting approximately 180° from the first foot support portion 210*a* to the third foot support portion 214*a* in a counterclockwise direction when observed from the front. An alternative way to understand and describe the foot support structure 200, however, is to understand and describe the foot support structure, in this example, as having two 90° twist portions that, when combined, provide an approximate 180° twist. In this alternative description, one of the 90° twist portions may extend from the first foot support portion 210*a* to the second foot support portion 212*a* twisting in a counterclockwise direction, and the other 90° twist portion may extend from the second foot support portion 212*a* to the third foot support portion 214*a* and also twisting in a counterclockwise direction. The two 90° twist portions, in this alternative description, may thus be described as meeting or joining at the second foot support portion 212*a*. In another alternative understanding and description, the second foot support portion 212*a* may be understood and described as part of the twist portion 216*a*. Additional and alternative understandings and descriptions for the twist portion will be appreciated with the benefit of this disclosure.

Several embodiments are described above and in the accompanying drawings. Other embodiments may include features in addition to and/or instead of features described above or shown in the drawings, may omit one or more features described above or shown in the drawings, and/or may include any combination or sub-combination of features described above or shown in the drawings. For example, additional embodiments may combine features from separate embodiments described above. With regard to claims directed to an article of manufacture or some other physical component or combination of components, a reference in the claim to a potential or intended wearer or a user of a component does not require actual wearing or using of the component or the presence of the wearer or user as part of the claimed component or component combination.

What is claimed is:

1. A foot support structure comprising:

a forefoot support plate;

a heel support plate;

a pair of twisted foot support members wherein each twisted foot support member includes a first foot support portion disposed in a first orientation and engaging the forefoot support plate, a second foot support portion disposed in a second orientation different than the first orientation, and a twist portion that extends continuously from the first foot support portion to the second foot support portion and twists from the first orientation to the second orientation; and wherein a common face of the first foot support portion and the second foot support portion extends continuously across the twist portion.

2. The foot support structure of claim 1 wherein:

the first foot support portion engages the forefoot support plate and faces a footbed of a foot-receiving structure when incorporated into the foot receiving structure; and the second foot support portion engages the heel support plate and faces a side of the foot-receiving structure when incorporated into the foot-receiving structure.

3. The foot support structure of claim 2 wherein the pair of twisted support members are joined together at the forefoot support plate.

4. The foot support structure of claim 2 wherein:

at least a portion of a first twisted foot support member of the pair extends along a lateral edge of the foot support structure; and at least a portion of a second twisted foot support member of the pair extends along a medial edge of the foot support structure.

5. The foot support structure of claim 4 further comprising:

a first cleat mounted to the heel support plate proximate to the lateral edge of the foot support structure;

a second cleat mounted to the heel support plate proximate to the medial edge of the foot support structure;

wherein the first cleat engages the first twisted foot support member; and wherein the second cleat engages the second twisted foot support member.

6. The foot support structure of claim 1 wherein each twisted foot support member of the pair of twisted foot support members further includes:

a third foot support portion disposed in the first orientation and engaging the heel support plate; and wherein, for each of the twisted foot support members, the second foot support portion is positioned between the first foot support portion and the third foot support portion, the twist portion extends continuously from the second foot support portion to the third foot support portion, and the common face is a common face of the first foot support portion, the second foot support portion, and the third foot support portion.

7. The foot support structure of claim 6 wherein, for each of the twisted foot support members, the first foot support portion and the third foot support portion face a footbed of a foot-receiving device when incorporated into the foot-receiving device; and the second foot support portion faces a side of the foot-receiving device when incorporated into the foot-receiving device.

8. The foot support structure of claim 7 wherein the pair of twisted foot support members are joined together at the heel support plate.

9. The foot support structure of claim 8 wherein each twisted foot support member of the pair further includes:

a pad extending from the first foot support portion toward a forefoot region of the foot support structure; and wherein the pad engages the forefoot support plate.

10. The foot support structure of claim 9 wherein the pair of twisted foot support members and the heel support plate are formed as a unitary one-piece construction.

11. The foot support structure of claim 6 wherein, for each of the twisted foot support members, the first foot support portion and the third foot support portion face a side of the foot-receiving device when incorporated into the foot-receiving device; and the second foot support portion faces a footbed of the foot-receiving device when incorporated into the foot receiving device.

12. The foot support structure of claim 6 wherein:

at least a portion of a first twisted foot support member of the pair extends along a lateral edge of the foot support structure; and at least a portion of a second twisted foot support member of the pair extends along a medial edge of the foot support structure.

13. The foot support structure of claim 12 further comprising:

a first cleat mounted to the heel support plate proximate to the lateral edge of the foot support structure;

a second cleat mounted to the heel support plate proximate to the medial edge of the foot support structure;

wherein the first cleat engages the first twisted foot support member; and wherein the second cleat engages the second twisted foot support member.

14. The foot support structure of claim 13 further comprising:

a third cleat mounted to the forefoot support structure proximate to the lateral edge of the foot support structure;

a fourth cleat mounted to the forefoot support plate proximate to the medial edge of the foot support structure;

wherein the third cleat engages the first twisted foot support member; and wherein the fourth cleat engages the second twisted foot support member.

* * * * *